US006071144A

United States Patent [19]

Tang

[11] Patent Number: 6,071,144

[45] Date of Patent: Jun. 6, 2000

[54] HERMETICALLY SEALED F-CONNECTOR

[76] Inventor: Danny Q. Tang, 2 Taylorr Lake Ct., Manalapan, N.J. 07726

[21] Appl. No.: 09/368,513

[22] Filed: Aug. 5, 1999

Related U.S. Application Data

[63] Continuation-in-part of application No. 09/150,283, Sep. 9, 1998.

[51] Int. Cl.[7] ..... H01R 4/24; H01R 4/26; H01R 11/20

[52] U.S. Cl. ..... 439/426; 439/579

[58] Field of Search ..... 439/426, 750, 439/857, 858, 578, 675, 589, 579

[56] References Cited

U.S. PATENT DOCUMENTS

| | | | |
|---|---|---|---|
| 3,581,269 | 5/1971 | Frey | 439/589 |
| 3,840,841 | 10/1974 | Clark | 439/589 |
| 4,497,531 | 2/1985 | Baker | 439/271 |
| 4,797,122 | 1/1989 | Kuboi | 439/589 |
| 4,944,692 | 7/1990 | Allina | 439/858 |
| 5,011,440 | 4/1991 | Lee | 439/857 |
| 5,667,409 | 9/1997 | Wong | 439/578 |

*Primary Examiner*—Lincoln Donovan
*Assistant Examiner*—Javaid Nasri
*Attorney, Agent, or Firm*—Kenneth Watov; Watov & Kipnes, P.C.

[57] ABSTRACT

A hermetically sealed female connector for a coaxial cable, includes a barrel-shaped brass housing enclosing in the order given from a top end providing an input port to a bottom end, a rubber boot having a center portion partially protruding from a central hole in the top end, a first cap having an upper portion within the boot and a lower portion, a second cap having an upper portion contained within the lower portion of the first cap, the second cap also having a lower portion with a top edge abutting against the bottom of the first cap, a rubber washer with a top face abutting against the bottom of the second cap, a plastic washer with a top face abutting against the bottom face of the rubber washer, and a clip pin secured in the central longitudinal portion of the housing between the input port and the bottom end with an end of the clip pin protruding out of the bottom end of the housing, the bottom end of the housing being peened over to retain the connector components under compression for causing the rubber boot and rubber washer to form hermetic seals with interior walls of the housing and clip pin.

49 Claims, 36 Drawing Sheets

(PRIOR ART) FIG. 9C

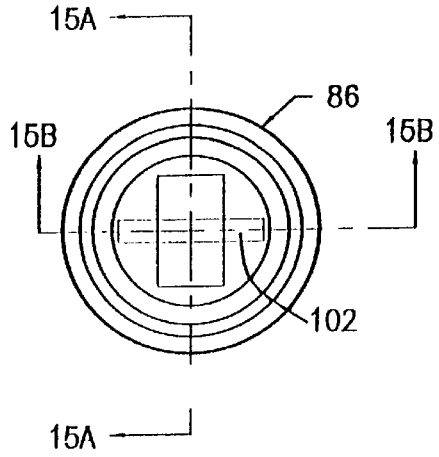
FIG. 15C
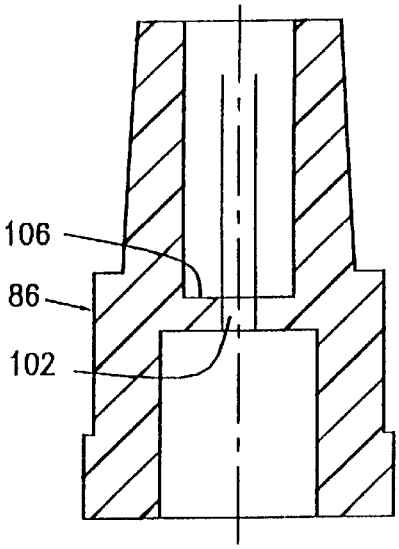
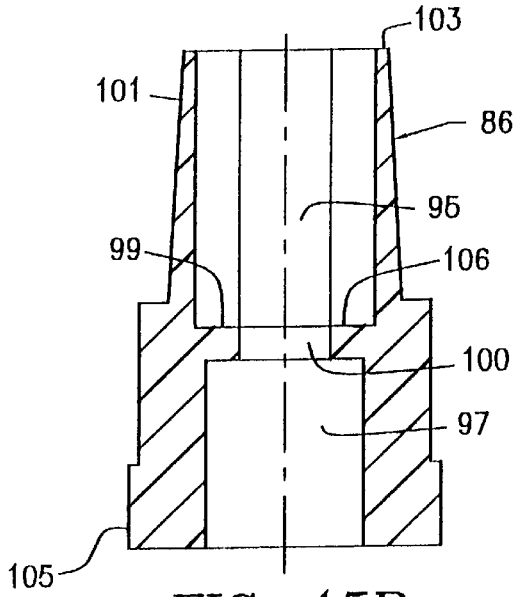
FIG. 15B
FIG. 15A
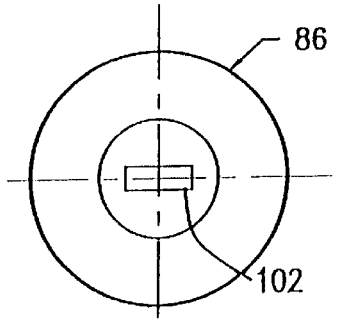
FIG. 15D

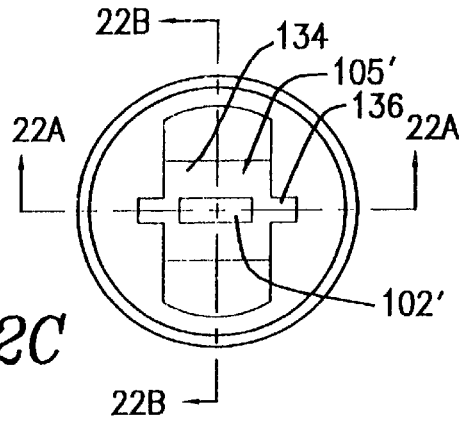
FIG. 22C
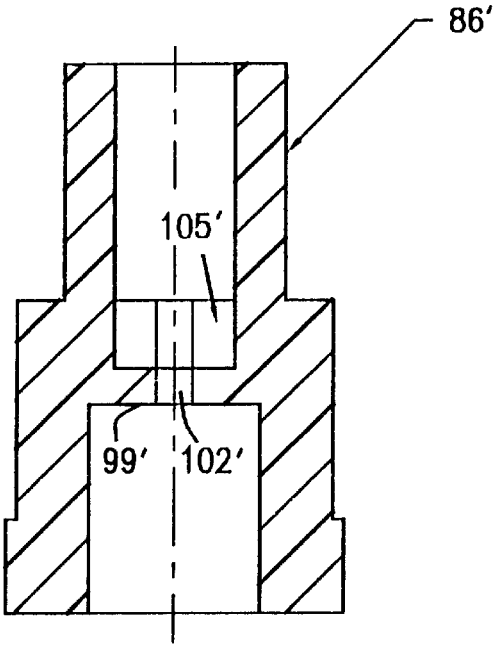
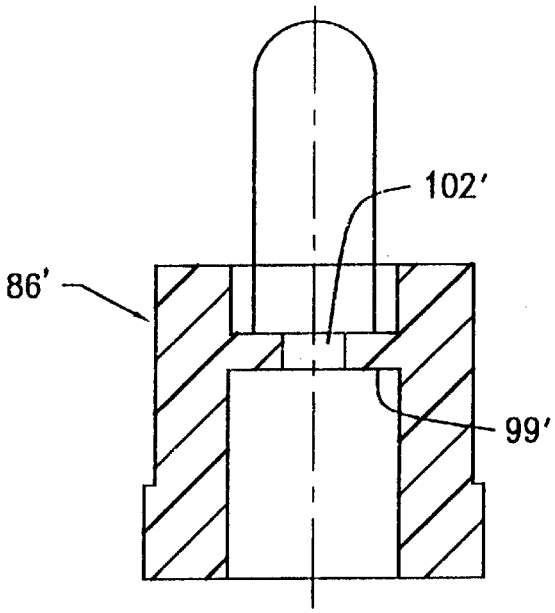
FIG. 22A
FIG. 22B
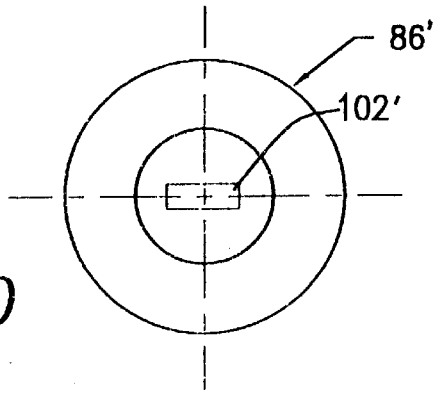
FIG. 22D

HERMETICALLY SEALED F-CONNECTOR

RELATED APPLICATION

This is a continuation-in-part of application Ser. No. 09/150,283, filed Sep. 9, 1998.

FIELD OF THE INVENTION

The field of the present invention relates generally to connectors for coaxial cables, and more particularly to hermetically sealed connectors for 75 ohm coaxial cable.

BACKGROUND OF THE INVENTION

In cable television systems a standard connector configuration, particularly with regard to the outer shell and mounting threads, is known as an F-connector, for connection to a 75 ohm coaxial cable. The type F-connectors come in many different configurations, depending upon the application. For indoor use, the assembly for such connectors is simpler, relative to outdoor use, in that the environmental conditions are less demanding. For outdoor use, it is important that the F-connectors be made as impervious to moisture as possible, particularly if the connectors are directly exposed to the atmosphere. Attempts have been made in the prior art to provide an F-connector that is impervious to moisture through use of a rubber boot at the end input port of a female configured F-connector for receiving the center conductor of a coaxial cable end secured to an associated male connector that screws onto the end of the female connector. As will be shown in detail below, the known best efforts to provide a moisture seal for such connectors in the prior art have not been satisfactory, in that over time moisture is still able to penetrate through the center portions of the connectors into housings on which the connectors are mounted. Typically, the connectors are configured for having one end secured onto a housing or cover plate for a housing via screwing a nut on the threaded mounting end of the connector. A center pin protruding from the mounting end of the connector is electrically connected within the housing to provide for connection to the coaxial cable expected to be coupled to the exposed other end of the F-connector. In view of moisture still being able over time to penetrate through the rubber boot at the exposed end of the connector, through the center pin into the housing the connectors mounted on, attempts have been made to overcome this by using a sealant material, such as RTV and/or epoxy, at the entry of the connector and its associated center pin into the housing. The use of sealant material in this manner is not always satisfactory, and over time moisture may still penetrate the housing upon which the connector is mounted.

SUMMARY OF THE INVENTION

It is an object of the present invention to provide an improved F-connector.

It is a further object of the invention to provide a hermetically sealed F-connector that has long term reliability for maintaining the hermetic seal.

With the problems in the prior art in mind, the present invention provides a hermetically sealed F-connector that includes a center clip pin configuration that reduces the possibility of moisture migrating down the center of the pin from the exposed input port end, through the connector onto the portion of the pin exiting in a housing upon which the connector is mounted. Also, other embodiments of the invention provide for an improved rubber boot design at the exposed end of the typical brass barrel of the connector, with underlying plastic cap means that during assembly is forced against the rubber boot for compressing the side and upper portions of the boot to seal against the inside sidewalls and upper wall portions of the barrel-shaped housing of the connector for substantially preventing moisture from entering into the connector from the atmosphere. The opposite end of the connector which is mounted within the housing of the device on which the connector is mounted, such as a cover plate of a multi-tap, for example, includes an internal rubber washer surrounding the input port end of the clip pin, with a portion of the washer being abutted against an end of the plastic cap means. A plastic washer mounted over the end of the clip pin is forced against the opposing face of the rubber washer to compress the washer in a manner causing it to form a tight seal around the associated inside wall portions of the connector barrel or cylindrically-shaped housing, and also into compression about the circumference of the clip pin passing through the rubber washer for providing a moisture seal with the pin and the connector housing. The bottom portion of the barrel-shaped housing is rolled over to secure the entire assembly, and retain the plastic washer in compressing against the rubber washer, in turning compression against the plastic cap means, for ultimately applying appropriate compressive forces against the rubber boot, as previously explained. The plastic cap means and clip pin are configured for securing the clip pin in the center portion of the connector housing, and preventing longitudinal movement of the pin. Other embodiments of the invention include providing longitudinal centrally located indentations in portions of the clip pin for strengthening the clip, and further providing rounding of the top portion of the clip pin, where a first rounded spring portion is abutted against an opposing second rounded pin portions, for receiving therebetween the center conductor of a coaxial cable mated to the connector via an associated male connector, and thereby providing a greater surface area for contacting the center conductor of the coaxial cable.

BRIEF DESCRIPTION OF THE DRAWINGS

Various embodiments of the present invention will be described in detailed below with reference to the accompanying drawings, in which like items are identified by the same reference designation, wherein:

FIG. 9C is a plan top view of the clip pin of FIG. 9B;

FIG. 15A is a longitudinal cross-sectional view of a lower cap taken along 15A—15A of FIG. 15C;

FIG. 15B is a longitudinal cross-sectional view taken along 15B—15B of FIG. 15C;

FIG. 15C is a plan top view of the cap of FIG. 15B;

FIG. 15D is a bottom view of the cap of FIG. 15B;

FIG. 22A is a longitudinal cross-sectional view taken along 22A—22A of FIG. 22C for a lower cap of the second embodiment of the invention;

FIG. 22B is a longitudinal cross-sectional view taken along 22B—22B of FIG. 22C of the lower plastic cap for the second embodiment of the invention;

FIG. 22C is a top plan view of the lower cap of FIG. 22A;

FIG. 22D is a bottom view of the lower cap of FIG. 22A;

DETAILED DESCRIPTION OF THE INVENTION

Figure 1:
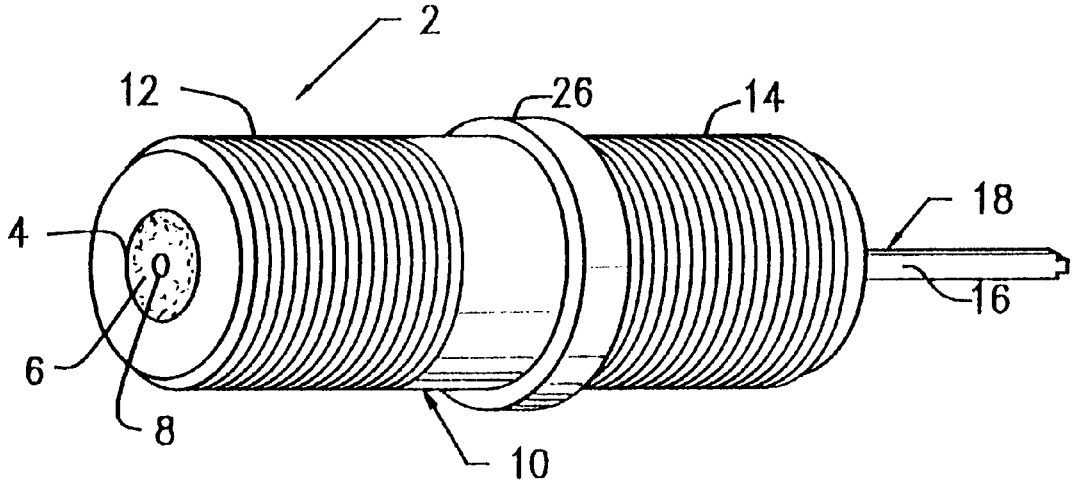
FIG. 1 shows a pictorial view looking toward the front end of a sealed F-connector.
Figure 2:
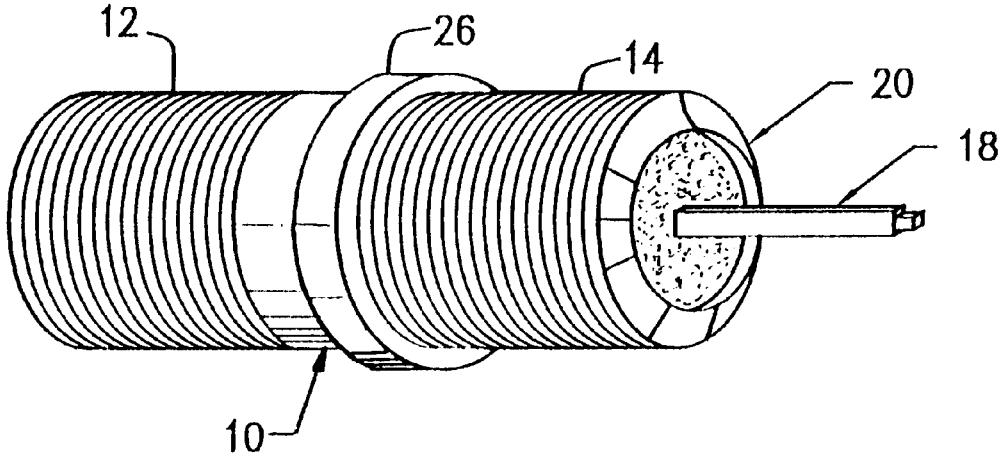
FIG. 2 is a pictorial view of the F-connector of FIG. 1 looking toward the back or rear end of the connector.

With reference to FIG. 1, a hermetically sealed F-connector 2 appears as shown in the front pictorial view thereof The outside appearance of this connector 2 is substantially the same as the outside appearance of known sealed-F-connectors of the prior art. The present connector includes an input port 4 at one end with a rubber boot 6 protruding from the port 4. The small depression 8 in the rubber boot 6 is for receiving an end of the center conductor of a coaxial cable secured to a male mating F-connector, whereby the conductor penetrates through the rubber boot 6 for engagement with a clip pin (shown below) secured within the connector 2. The main body or housing of the connector 2 is in the form of a barrel 10 that fib includes an upper threaded portion 12, and a lower threaded portion 14. In certain applications the lower portion may not be threaded, but configured for press fitting into a hole in a mounting plate, for example. The threads of portions 12 and 14 are standard UNF threads. The threads of the upper threaded portion 12 permit the cap of a mating male F-connector to be securely screwed onto the top of the barrel 10 over the input port 4. The lower threaded portion 14 permits the rear portion of the barrel 10 to be mounted on a panel or cover plate of a device by pushing the rear end of the barrel 10 through a hole in the panel or cover until the raised portion 26 of the barrel 10 stops further penetration of the barrel into the panel or cover plate, permitting a nut 15 (see FIG. 4) to be installed on the other side upon the threaded portion 14 for securing the connector 2 in place. Alternatively, the threaded portion 14 can be screwed into a threaded mounting hole, and secured with adhesive material, eliminating the need for a nut. An end portion 16 of a clip pin 18 protrudes from the center face at the rear of the connector 2, for permitting electrical connections to be made to the clip pin 18, the other end of which is configured for receiving the end of a center conductor of a coaxial cable, as will be described in greater detailed below. FIG. 2 is a pictorial view of the connector 2 viewed from the rear end of the connector 2.

Figure 3:
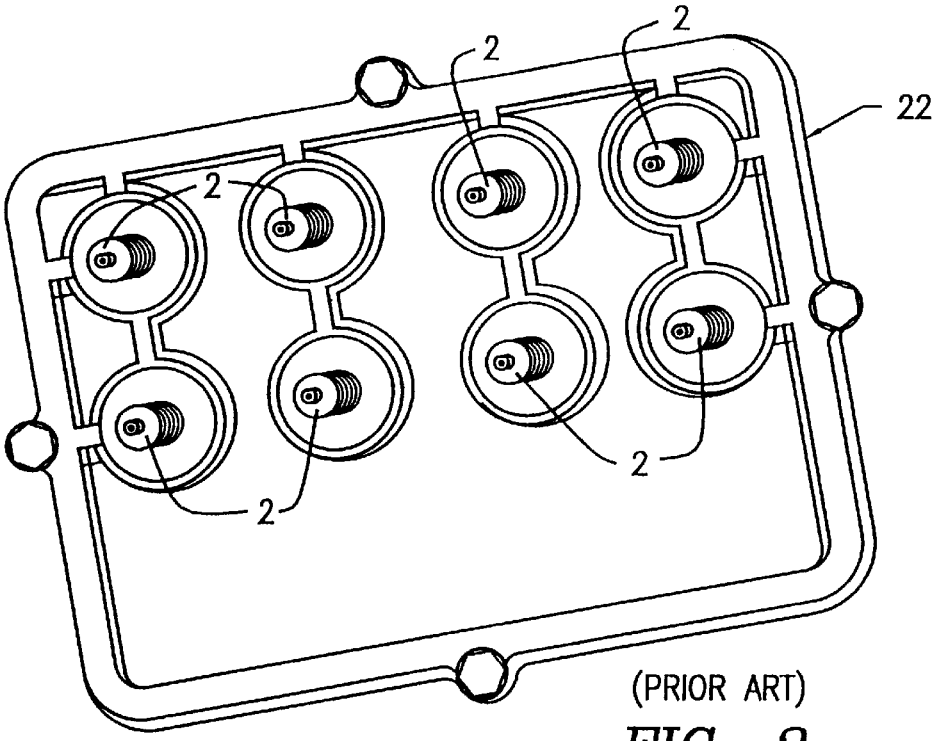
(PRIOR ART) FIG. 3
FIG. 3 is a pictorial view of a cover plate for a multi-tap device having a plurality of F-connectors of the prior art mounted thereon.
Figure 4:
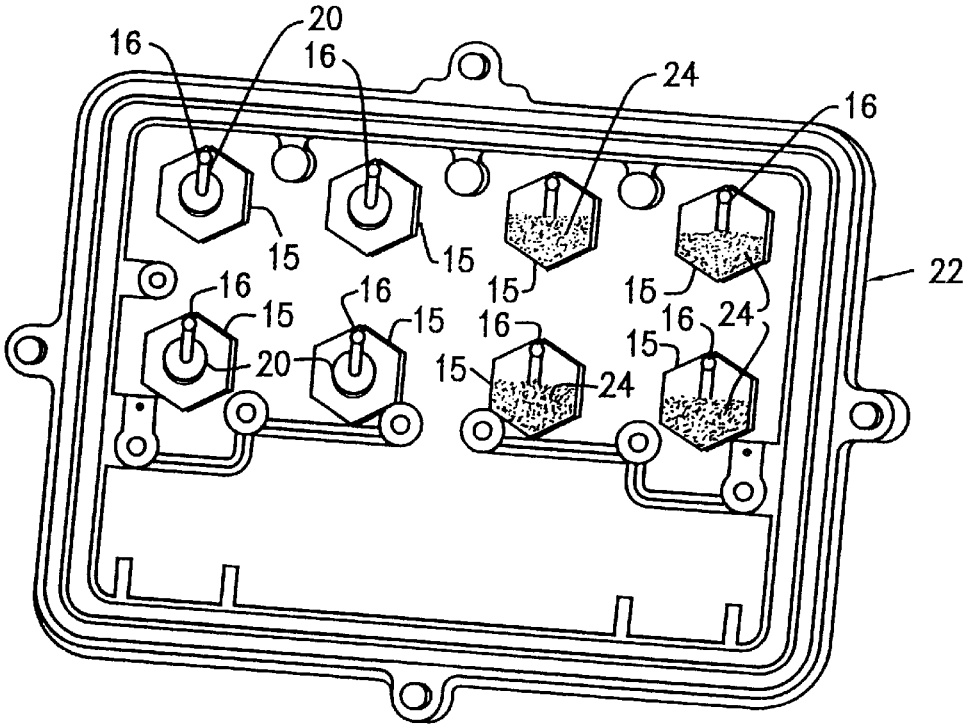
(PRIOR ART) FIG. 4
FIG. 4 is a pictorial view of the inside surface of the cover plate of FIG. 3 showing the use of sealant material in the prior art for assisting in preventing moisture from entering into the multi-tap housing through the F-connectors.

FIG. 3 shows a typical prior art configuration of a cover plate 22 for a multi-tap, looking at the front or top of the cover plate 22 upon which a plurality of F-connectors 2 are mounted. In FIG. 4, the rear end of the cover plate 22 is shown with the rear ends 20 of the connectors 2 protruding therefrom. Note the use of sealant material 24 covering the rear ends 20 (see FIG. 2) and a portion of the clip pin ends 16 of each of the connectors 2 in an attempt to prevent moisture from entering into the enclosure of the multi-tap to which the cover plate 22 is affixed during use, in this example. Although use of an appropriate sealant 24, such as an epoxy or silicone seal, may for a time prevent moisture from migrating into the main housing of a multi-tap (not shown), in this example, it has been found in field tests that eventually in many installations moisture may be able to migrate through the clip pin 18 into the enclosure. The reasons for this happening are due to deficiencies in the design of the prior sealed F-connectors, as will be described below.

Figure 5:
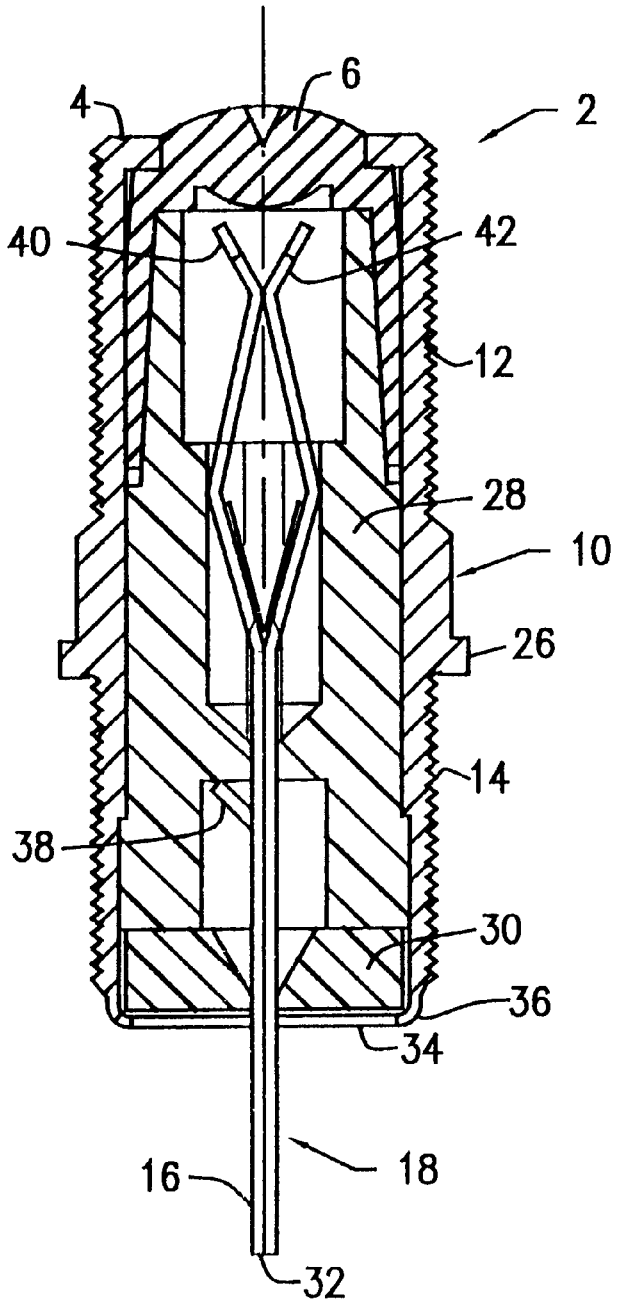
(PRIOR ART) FIG. 5
FIG. 5 is a longitudinal cross-sectional view of a sealed F-connector of the prior art.

With reference to FIG. 5, a prior art sealed F-connector 2 includes a barrel 10 having upper and lower threaded portions 12, 14, respectively, a nut-shaped or rounded protrusion 26 of greater diameter than a hole in which the connector 2 is mounted, a clip pin 18 having an exposed end portion 16, a rubber boot 6, a single plastic cap 28, and a plastic washer 30, shaped as shown. Note that the transverse cross-sections for each of the rubber boot 6, barrel 10 (except for the nut-shaped protrusion 26), plastic cap 28, and plastic washer 30, are all circular. In certain configurations protrusion 26 may also be circular. The interior cavity of the barrel 10 is a hollow cylinder. Note further that although the barrel 10 typically consists of brass material, and must be electrically conductive for providing the ground termination for the coaxial cable secured to the connector 2, materials other than brass can be used. The clip pin 18, as will be described in greater detail below, includes two opposing spring metal halves formed by bending the two opposing sections about the tip 32 of the end portion 16 of the clip pin 18, as shown. To assemble the connector 2, the various components as described are slid into the barrel 10 from the bottom end 34. The bottom edge portion 36 of the barrel 10 is bent radially inward as shown for securing the various component elements of the connector 2 in to place, whereby the plastic washer 30, in this example, is also forced upward to in turn force the plastic cap 28 to compress portions of the rubber boot 6 against both the inside wall of the barrel 10, and further against the transverse inside wall of barrel 10 about the input port 4. Note that the clip pin 18 includes a bent tab portion 38 to prevent upward movement of the clip pin 18 should an upward force be applied against the end portion 16 thereof.

As previously indicated, the sealed F-connector 2 having the prior art configuration shown in FIG. 5 has proven to over time permit moisture to migrate through the connector 2 into a housing to which the connector 2 is attached. The main pathway for the migration of moisture is through the center of the rubber boot 6 where the center conductor of the associated coaxial cable of the mating male F-connector (not shown) penetrates through the boot 6 to engage the clip pin 18 between the opposing corner portions of the first and second ears 40, 42, respectively, bent away from each other as shown to provide electrical contacts for the center conductor of a coaxial cable. Over time the moisture tends to flow down the center of the clip pin 18, and to exit within an associated housing from the end portion 16. Also the seal provided by the rubber boot 6 is inadequate, and also may permit moisture to enter into the interior of the connector 2. Further, the plastic washer 30 at the bottom of the connector 2 does not provide any moisture seal in that region of the connector 2.

Figure 6:
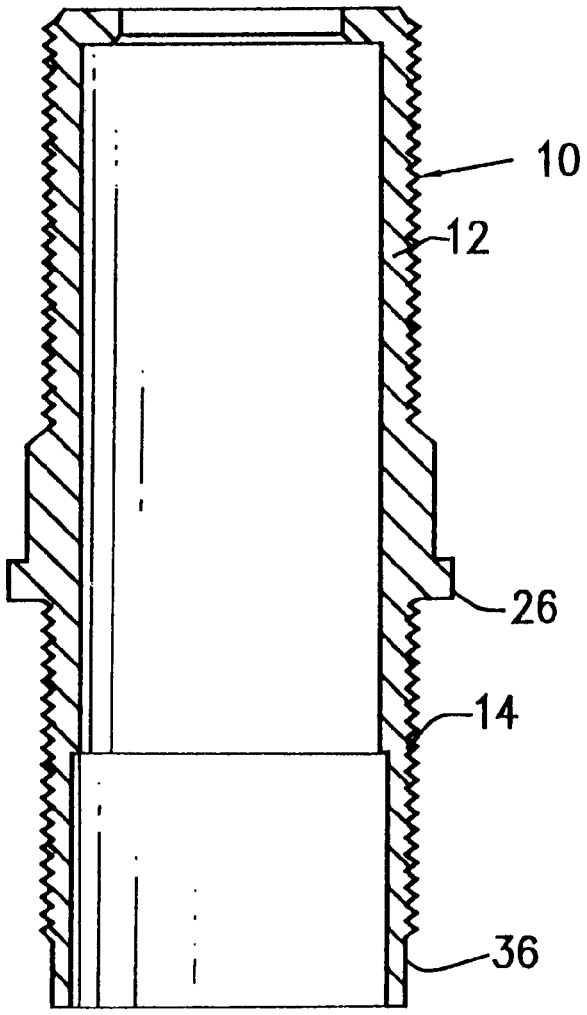
(PRIOR ART) FIG. 6
FIG. 6 shows a longitudinal cross-sectional elevational view of a brass barrel, in this example, for an F-connector of the prior art.

In FIG. 6, a longitudinal cross-sectional view is shown of a standard barrel 10 for an F-connector. Note that this standard barrel 10 is used in the various embodiments of the present invention.

Figure 7:
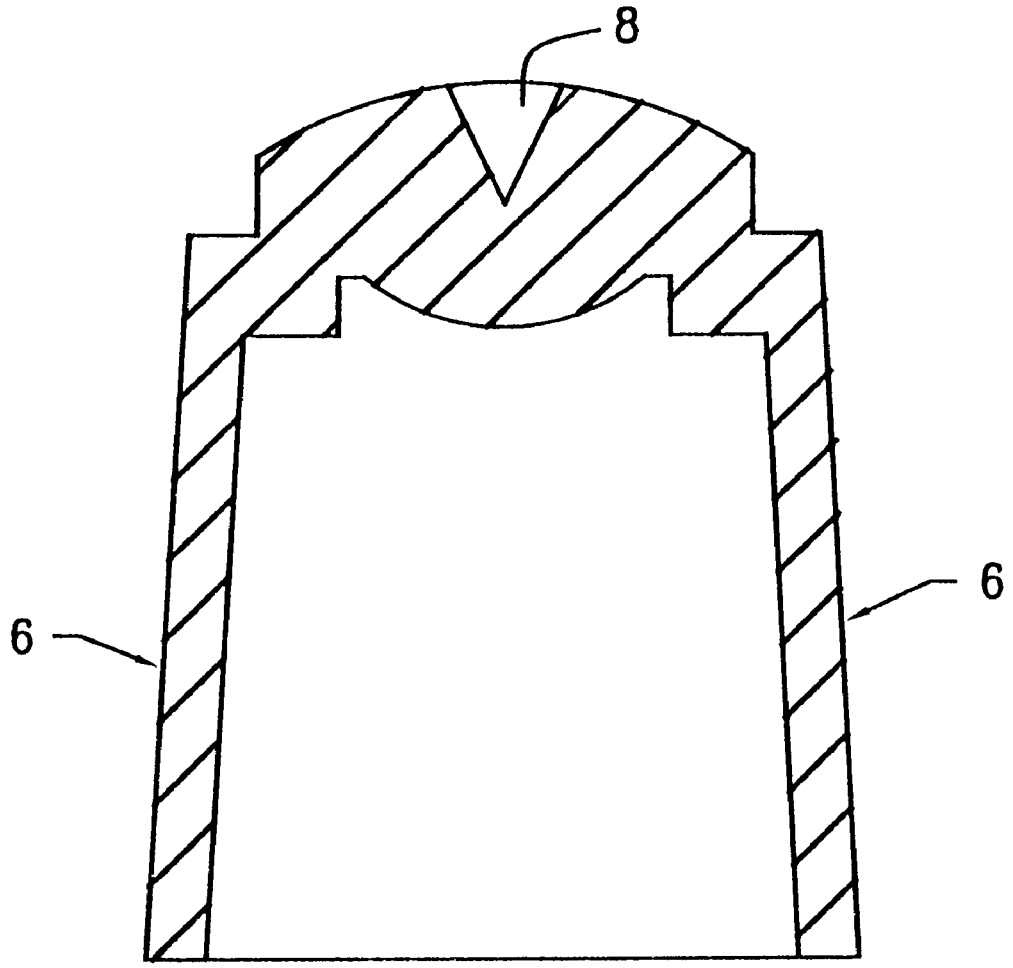
(PRIOR ART) FIG. 7
FIG. 7 is an elevational cross-sectional view of a rubber boot of the prior art sealed F-connector.
Figure 8C:
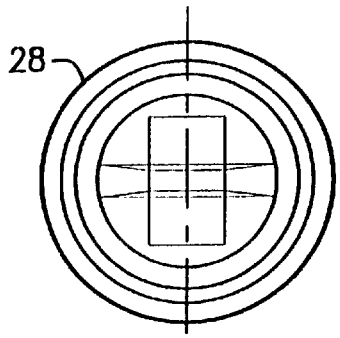
(PRIOR ART) FIG. 8C
FIG. 8C is a top plan view of the plastic cap of FIG. 8B.
Figure 8A:
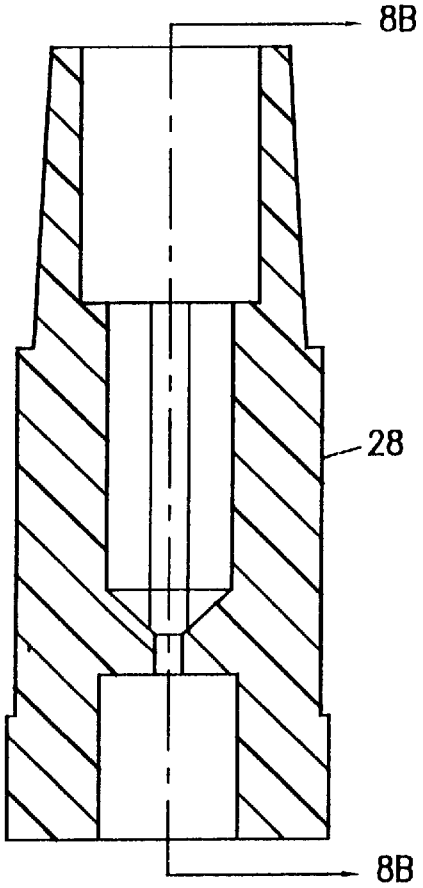
(PRIOR ART) FIG. 8A
FIG. 8A is a longitudinal cross-sectional elevational view of a plastic cap of the prior art sealed F-Connector.
Figure 8B:
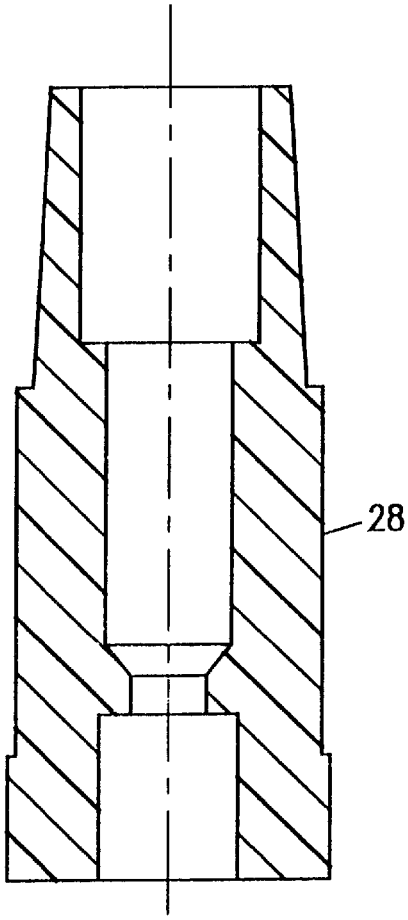
(PRIOR ART) FIG. 8B
FIG. 8B is a longitudinal cross-sectional elevational view taken along 8B—8B of FIG. 8A.

In FIG. 7 the rubber boot 6 of the prior art is shown in a longitudinal cross-sectional view. Similarly, for purposes of comparison with various embodiments of the present invention, the prior plastic cap 28 design details are shown in FIGS. 8A, 8B, and 8C, respectively.

Figure 9A:
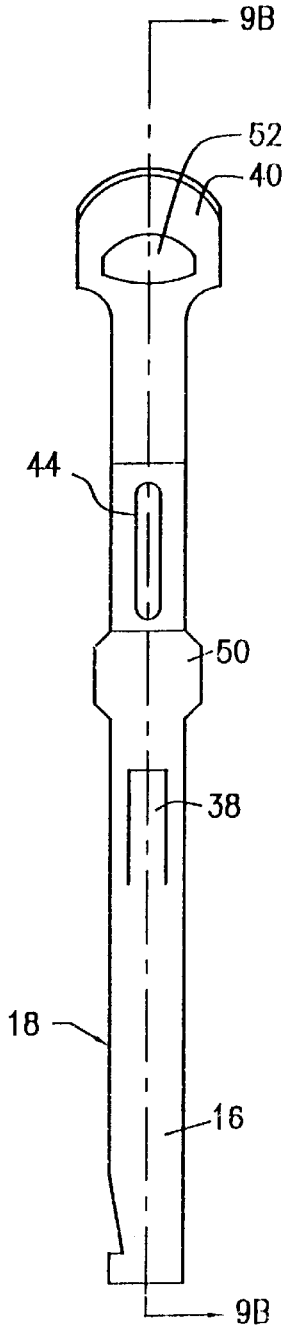
(PRIOR ART) FIG. 9A
FIG. 9A is an elevational view of one side of a clip pin of the prior art sealed F-connector.

With reference to the front elevational view of FIG. 9A for clip pin 16, note the strengthening indentation 44. Also, with reference to FIG. 9B, note that the upper portion of the clip pin 18 includes opposing first and second V-shaped members 46 and 48. Note further in FIG. 9A, the central portion 50 of clip pin 18 that is wider than other portions thereof, and serves the purpose as can be seen in FIG. 5 to abut against an interior portion of plastic cap 28, for preventing downward movement of the clip pin 18 due to a downward force being applied to the upper portion thereof. Note further the arcuate opening 52 that is formed in each one of the contact ears 40 and 42. In FIG. 9C a top plan view looking down upon the first and second ears 40, 42, respectively, shows arc-like wiping surfaces 54.

With further reference to FIG. 9A, note that the clip pin 18 of the prior art is formed from one piece of material which is folded back upon itself at the tip of the end portion 32, as shown. Particularly note the open gap between the opposing members of the clip pin 18. As previously indicated, this gap provides a conduit for the migration of moisture entering through the rubber boot 6 into the interior of the connector 2. When the moisture is able to migrate down into the end portion 16, it then passes into the interior of the housing of the device upon which the connector 2 is mounted.

Figure 10A:
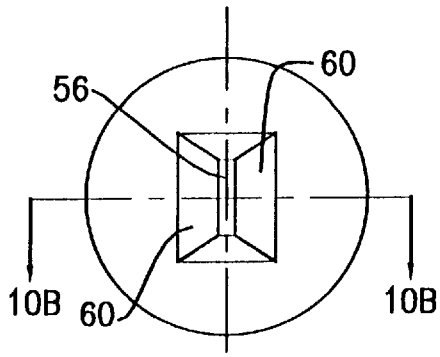
(PRIOR ART) FIG. 10A
FIG. 10A is a plan top view of a plastic washer of the prior art sealed F-connector.
Figure 10B:
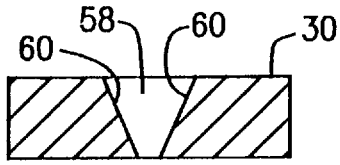
(PRIOR ART) FIG. 10B
FIG. 10B is a cross-sectional elevational view taken along 10B—10B of FIG. 10A of the plastic washer.
Figure 10C:
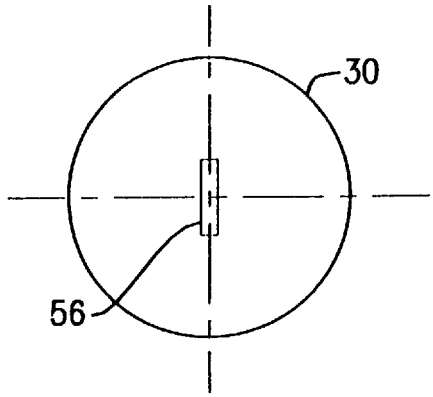
(PRIOR ART) FIG. 10C
FIG. 10C is a bottom view of the plastic washer of FIG. 10B.

FIGS. 10A, 10B, and 10C, show the design of the plastic washer 30. The washer 30 includes a centrally located rectangular through-hole 56 in the bottom of the washer 30 through which the end portion 16 of the clip pin 18 passes. Note that the top opening 58 of the washer 30 is substantially larger than the bottom opening 56, whereby converging sidewalls 60 are formed between the openings 58 and 56, as shown, for permitting entry of the clip pin end portion 16 therethrough.

Figure 11:
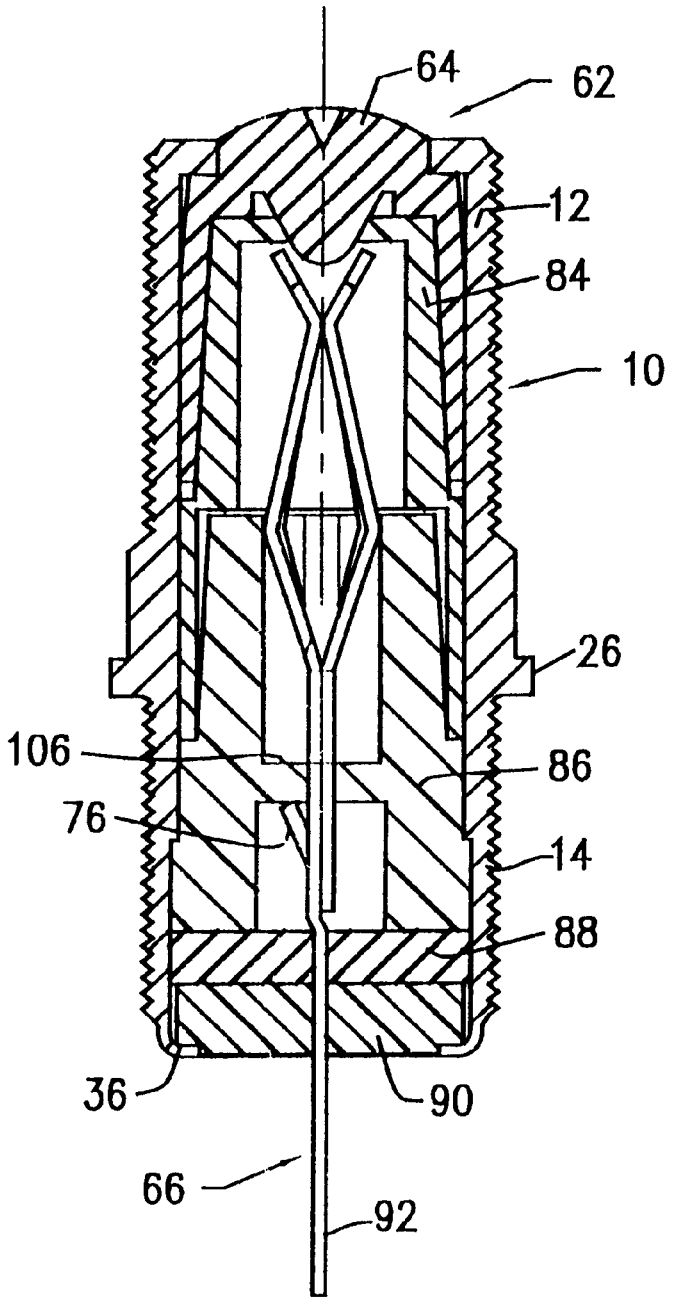
FIG. 11 is a longitudinal cross-sectional elevational view of a hermetically sealed F-connector for a first embodiment of the invention.
Figure 11A:
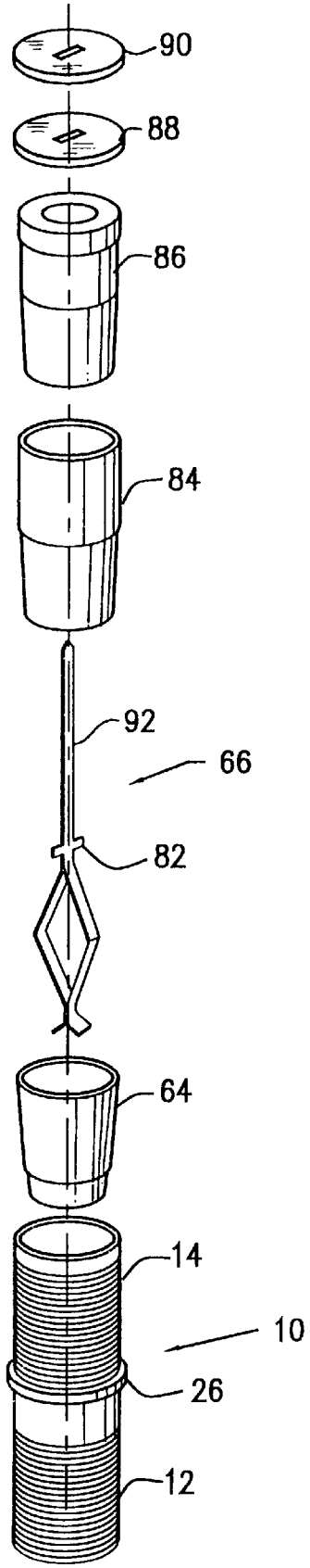
FIG. 11A is an exploded assembly diagram of a first embodiment of the invention.
Figure 12:
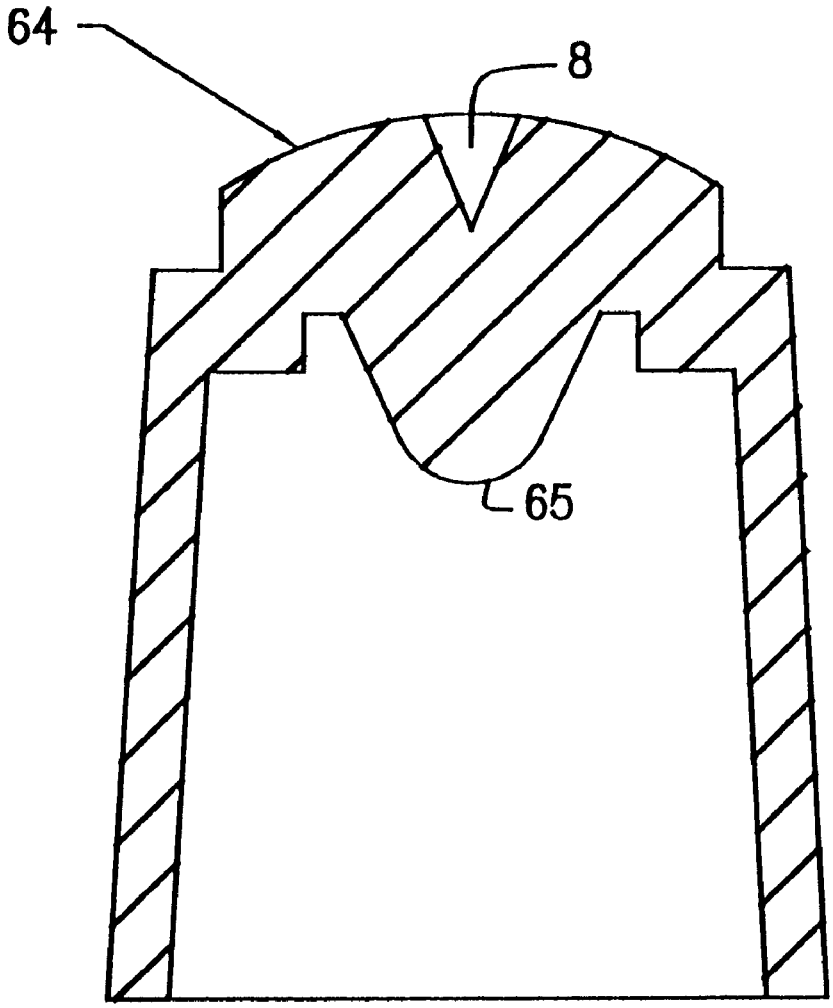
FIG. 12 is a longitudinal cross-sectional view of a rubber boot for the first embodiment of the invention.

In a first embodiment of the invention, a hermetically sealed F-connector for one embodiment of the invention is shown in FIGS. 11A through 17C. With reference to FIG. 11, a longitudinal cross-sectional view of the hermetically sealed F-connector 62 for the first embodiment of the invention is shown. The barrel 10 is substantially the same as the barrel 10 in the prior art for this and other embodiments of the invention, but all other components of the new connector 62 have been redesigned and improved in order to obtain a true and reliable hermetic seal. A new boot 64 includes a thicker midsection. Also, a comparison of the prior boot 6 shown in FIG. 7 relative to the new boot design 64 shown in FIG. 12 shows that certain dimensions remain unchanged between the two, whereas other features have been designed to have a different dimension in the boot 64 for improved performance. Although the boot 64 is in the preferred embodiment fabricated from rubber material, any suitable material can be used.

Figure 9B:
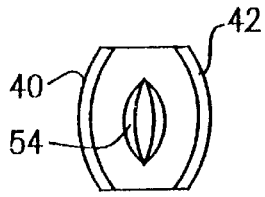
(PRIOR ART) FIG. 9B
FIG. 9B is an elevational view of the clip pin of FIG. 9A rotated 90° looking along 9B—9B.
Figure 9B:
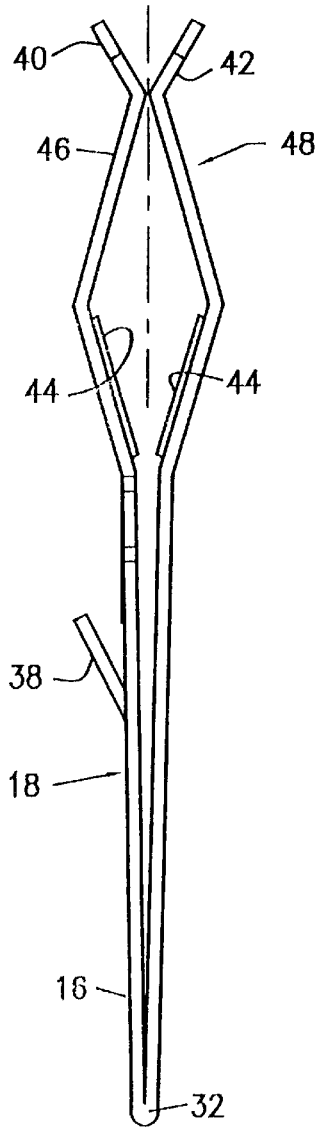
(PRIOR ART) FIG. 9B
Figure 14C:
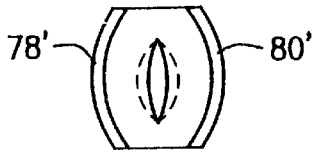
FIG. 14C is a top plan view of the clip pin of FIG. 14B.
Figure 14A:
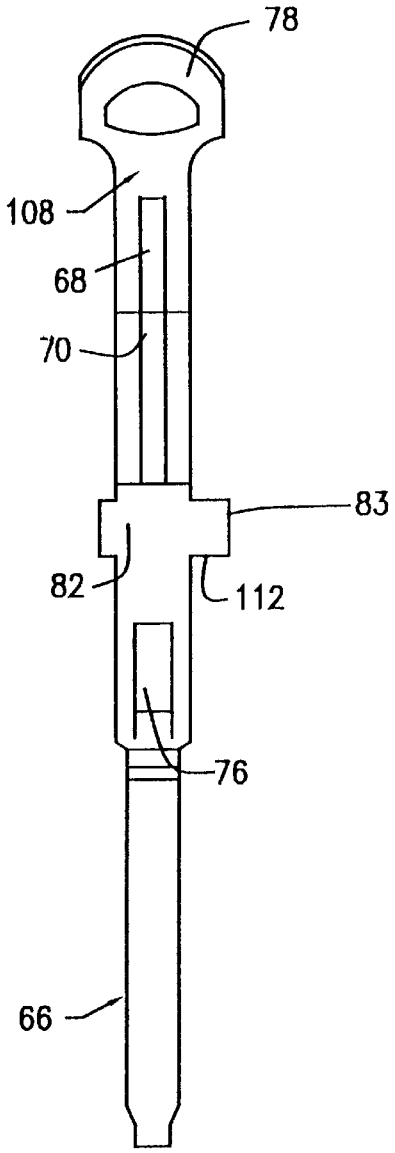
FIG. 14A is a front elevational view of a clip pin of the first embodiment of the invention.
Figure 14B:
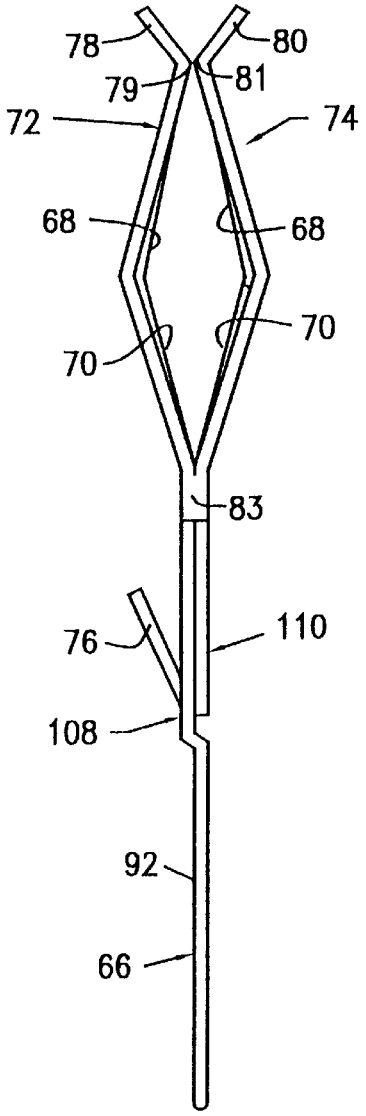
FIG. 14B is a side elevational view of the clip pin of FIG. 14A rotated 90° counterclockwise about its longitudinal axis.
Figure 14D:
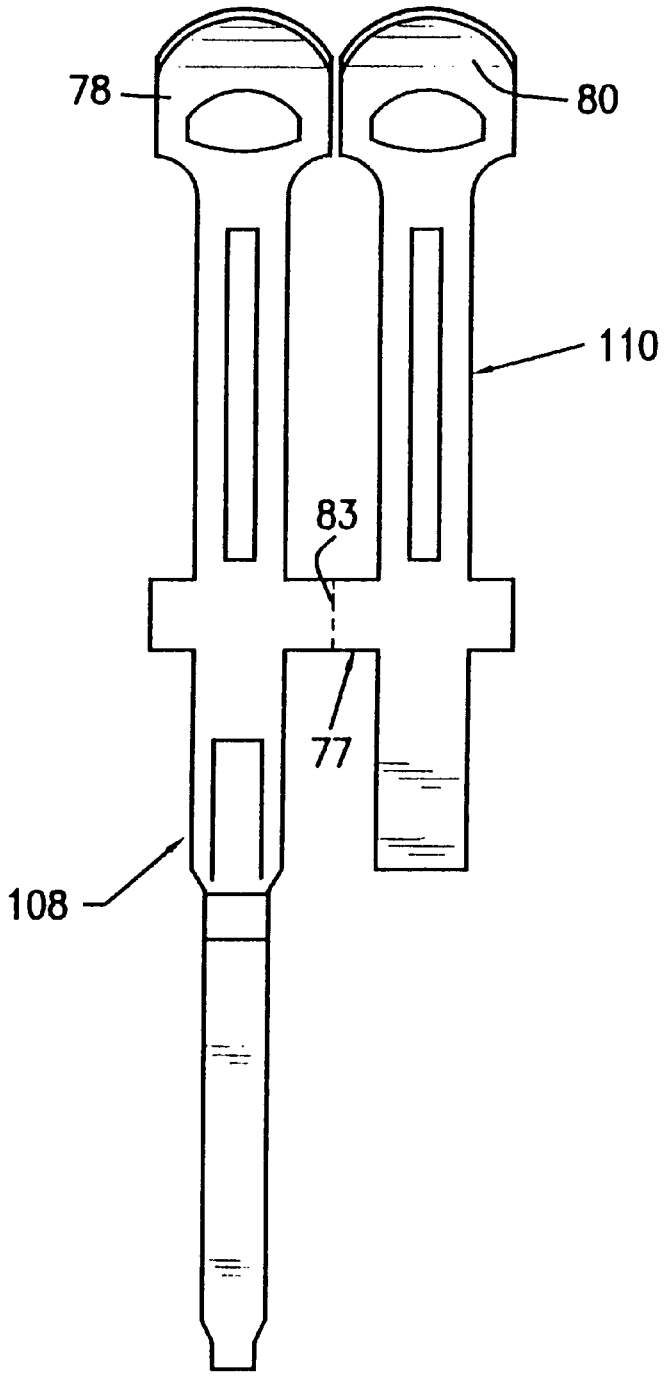
FIG. 14D is a front elevational view of the clip pin of FIGS. 14A, 14B, and 14C, before bending its two half sections upon one another.

Substantial changes have been made in the design of the new clip pin 66 relative to the to prior clip pin 16, as can be seen by directly comparing FIGS. 9A, 9B, and 9C, relative to the new clip pin 66 design shown in FIGS. 14A, 14B, and 14C. More particularly, certain of the major differences in the new clip pin 66 include making the end portion 92 from a single piece of material rather than two opposing folded over pieces of material as with the end portion 16 of the prior clip pin 18. The new clip pin 66 also includes upper and lower strengthening ribs 68, 70, respectively, as shown in the opposing V-shaped portions 72, 74, respectively. A bent tab portion 76 serves the same function as the bent tab portion 38 of clip pin 16. Also, in the new pin 66 design the first and second contact ears 78, 80, respectively, oppose one another at an increased angle and are reduced in length in comparison to the ears 40, 42, respectively, of the prior clip pin 16. The midsection 82 of the new clip pin 66 is of modified design as shown in FIG. 14A, relative to midsection or central portion 50 of the prior clip pin 18 of FIG. 9A. In comparing the top plan view of FIG. 9C of the prior clip pin 16 relative to the top plan view of FIG. 14C of the improved clip pin 66 shows that the latter has a reduced width. Also, as shown in FIG. 14D, in this example the clip pin 66 is formed from a single piece of material by folding the first and second halves 108 and 110 along bend line 83 of bridge portion 77 connecting the halves, to obtain the configuration of FIG. 14B. Section 110 is similar in configuration to section 108, but the former does not include end portion 92, tab portion 112, and bent tab portion 76. Accordingly, a side view of section 110 is not shown.

With further comparison of the first embodiment of the invention to the prior sealed F-connector, the prior configuration (see FIG. 5) includes a single plastic cap 28, whereas the first embodiment of the present invention as shown in FIG. 11, includes an upper cap 84 and It a lower cap 86. Also, in the first embodiment of the invention, a rubber washer 88 is included for sealing the bottom portion of the connector 62, as shown. As shown, included beneath the rubber washer 88 is a plastic washer 90. Also, as previously mentioned, the end portion 92 of the clip pin 66 of the first embodiment is a single piece of material unlike the previously described end portion 16 for prior clip pin 18, as shown.

Figure 13C:
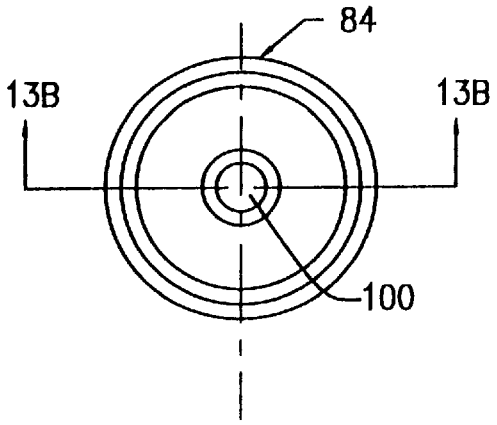
FIG. 13C is a top plan view of the upper cap of FIG. 13A.
Figure 13B:
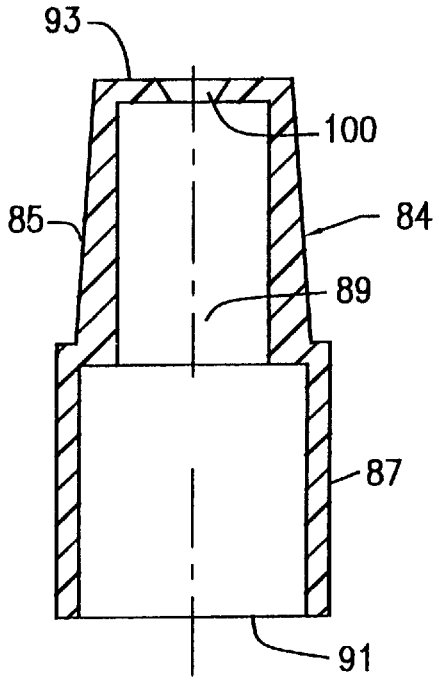
FIG. 13B is a longitudinal cross-sectional view taken along 13B—13B of FIG. 13A.
Figure 13A:
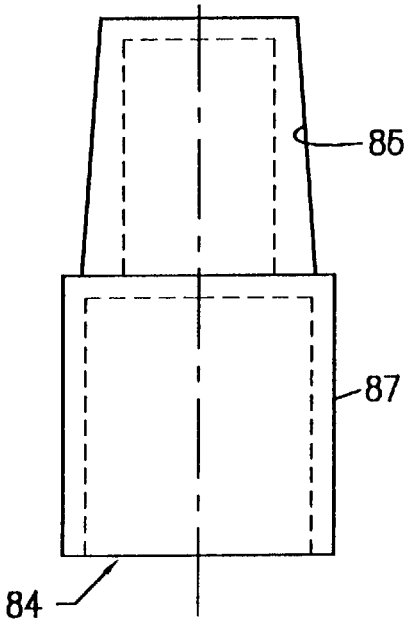
FIG. 13A is a front elevational view of an upper cap of the first embodiment of the invention.
Figure 13D:
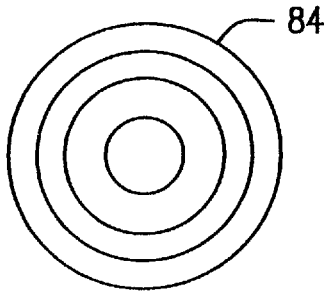
FIG. 13D is a bottom view of the upper cap of FIG. 13A.

FIGS. 13A, 13B, and 13C, show design details for the upper cap 84 of the first embodiment. FIGS. 15A, 15B, and 15C show design details for the lower cap 86 for the first embodiment. The upper cap 84 includes an upper portion 85 with diverging sidewalls, parallel sidewalls for a widened lower portion 87, and a hollow interior cavity 89. The bottom 91 is open, and the top 93 has a centrally located hole 100. The lower cap 86 includes an upper portion 101 with diverging sidewalls from the top 103 to a lower portion 105, the latter having parallel sidewalls of greater outside diameter than the upper portion 101. A partition 99 separates the interior cavities 95 and 97. Two intersecting rectangularly-shaped holes 102 and 100 included through the partition 99, as shown.

Figure 16A:
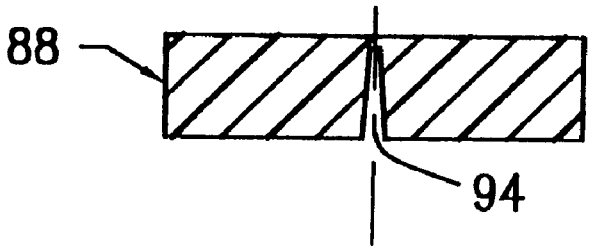
FIG. 16A is a cross-sectional view taken along 16A—16A of FIG. 16B for a rubber washer of a first embodiment of the invention.
Figure 16B:
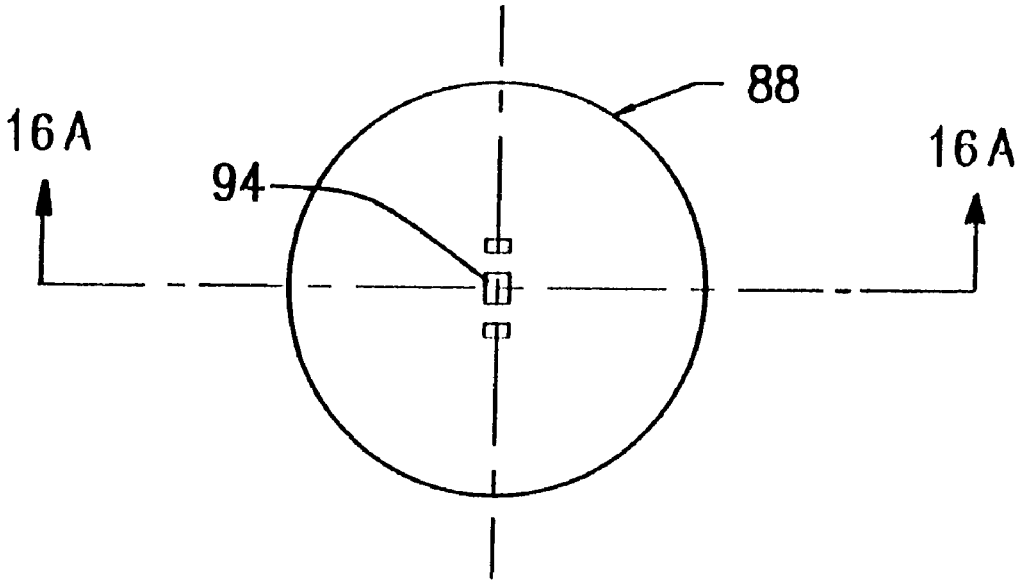
FIG. 16B is a top plan view of the rubber washer of FIG. 16A.

FIGS. 16A and 16B show the design for the rubber washer 88 of the first embodiment of the invention. As shown, the washer 88 includes a centrally located hole 94 through which the end portion 92 of the clip pin 66 passes, whereby in the assembled configuration of the connector 62 the rubber seals about the end portion 92, as will be described in greater detail below.

Figure 17B:
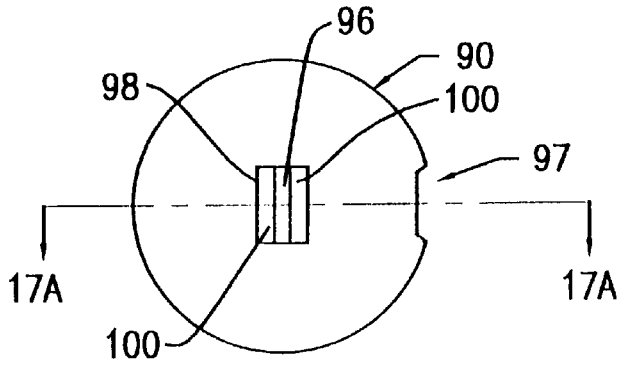
FIG. 17B is a top plan view of the plastic washer of FIG. 17A.
Figure 17A:
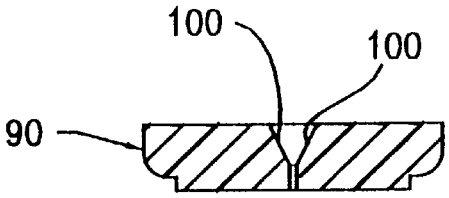
FIG. 17A is a cross-sectional view taken along 17A—17A of FIG. 17B for a plastic washer of the first embodiment of the invention.
Figure 17C:
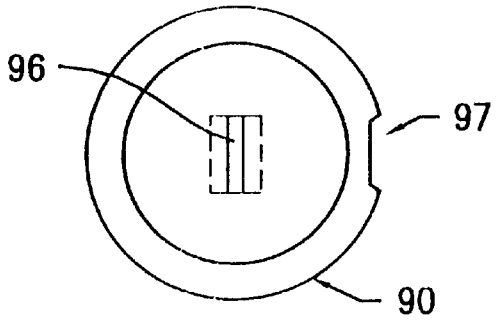
FIG. 17C is a bottom view of a plastic washer of FIG. 17A.

The design of the plastic washer 90 of the first embodiment of the invention is shown in FIGS. 17A, 17B, and 17C, respectively. The plastic washer 90 includes an index groove 97, and a centrally located rectangular through-hole 96 through which the end portion 92 of clip pin 66 passes as shown in FIG. 11. As shown in the cross-sectional view of FIG. 17A, the top of the washer 90 includes a centrally located rectangular opening 98 that is larger than the through-hole 96, and provides converging side portions 100 from opening 98 to through hole 96, for assisting in assembly.

Note that throughout this detailed description, certain material may be called out for showing the preferred embodiments of the invention. However, any suitable material may be used for the various components or connector parts described in the various embodiments of the invention.

With reference to FIG. 11A, an exploded assembly diagram is shown for the first embodiment of the invention. The rubber boot 64 is pushed into the barrel 10 from the bottom end of the barrel as shown, the top of the boot 64 entering first. Next, lower cap 86 is pushed into the upper cap 84, and the clip pin 66 has its end portion 92 pushed first through the central hole 100 (see FIG. 13B) of the upper cap 84, and then through the central rectangular hole 102 of the lower cap 86 (see FIGS. 15A, 15B, and 15C) until the bent tab portion 76 of clip pin 66 snaps through the latter hole 102, whereby this subassembly is then pushed into the barrel 10 as far as it will go for pushing the upper portion of upper cap 84 into the cavity of the boot 64, (see FIG. 11). The rubber washer 88 is then installed over the end portion 92, followed by the plastic washer 90, in this example. Pressure is then applied to the plastic washer 90, and the bottom edge portion of the barrel 10 is rolled over to retain the assembly under compression, for forcing the boot 64 to seal against interior wall portions of the barrel 10, and also compress the center hole of boot 64 to seal around the center conductor of a coaxial cable by pressure from upper cap 84 (see FIGS. 11 and 11A) forcing the beveled hole 100 to contact and compress the cone portion 65 of boot 64 to hermetically seal around a center conductor of a coaxial cable passing through boot 64. Also, the rubber washer 88 is compressed to similarly provide a hermetic seal against the interior abutting walls of barrel 10 and around the end portion 92 passing therethrough. In this manner, both the boot 64 and the washer 88 provide a positive hermetic seal for the connector 62 to prevent moisture from entering into the interior thereof. Note that the central widened portion 82 of clip pin 66 of FIG. 14 prevents it from moving downward relative to the input port when a downward force is applied, in that the portion 82 is abutted against the top inside surface 106 of the lower cap 86 (see FIGS. 15A and 15B). Also, the clip pin 66 is prevented from moving upward due to a force applied to the end portion 92 in an upward direction via the bent tab 76 abutting against the bottom inside surface of cross-member 106 of the lower cap 86 (see FIG. 15B). The first embodiment of the invention has been shown to provide a reliable hermetically sealed F-connector.

Figure 18A:
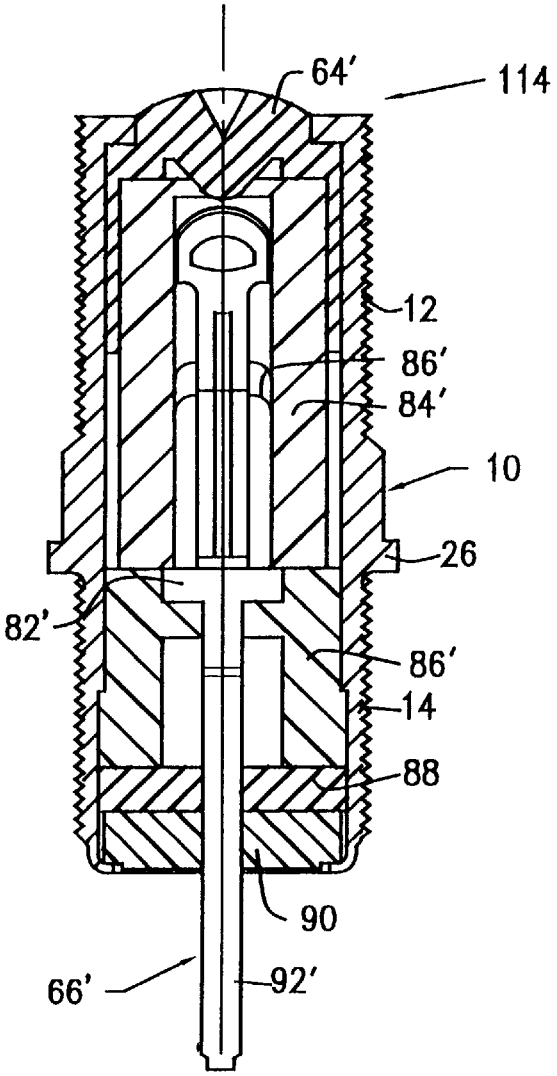
FIG. 18A is a longitudinal cross-sectional view of a hermetically sealed F-connector for a second embodiment of the invention.
Figure 18B:
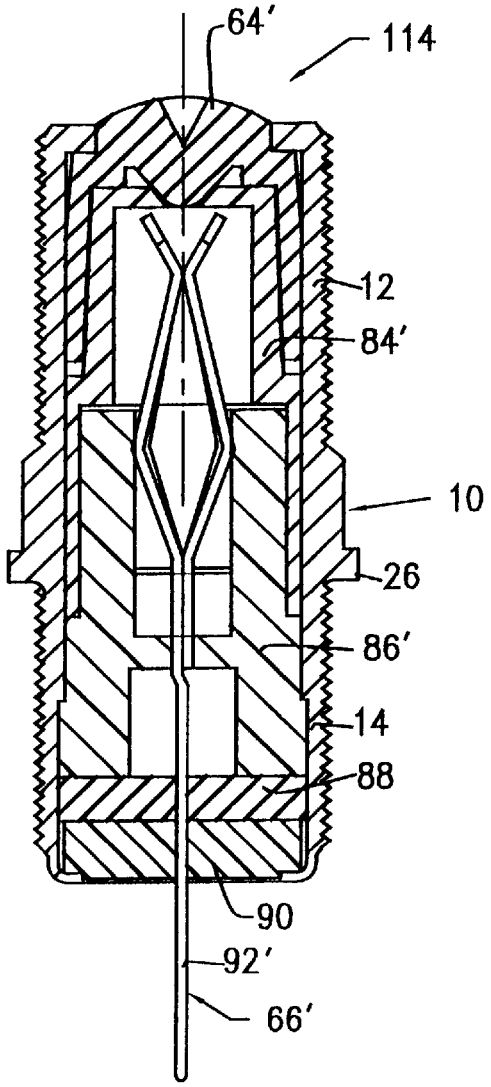
FIG. 18B is a longitudinal cross-sectional view of the connector of FIG. 18A rotated 90° counterclockwise.

In a second embodiment of the invention, as shown in FIGS. 18A through 22D, an alternative hermetically sealed F-connector 114 is shown. With reference to FIGS. 18A and 18B, only the barrel 10, rubber washer 88, and plastic washer 90 are substantially identical to the like components of the first embodiment of the invention previously described. However, the design philosophy between the various embodiments of the invention presented herein remain similar. Similar to the first embodiment of the invention, the second embodiment also includes a rubber boot 64', an upper cap 84', a lower cap 86', a clip pin 66', and a clip pin end portion 92', as shown in FIGS. 18A and 18B. Note that the bent tab 76 of the first embodiment of the invention is not included in the clip pin 66' of the second embodiment. In the second embodiment, the widened central portion 82' of the clip pin 66' is captively held between the topmost central located cavity of the lower cap section 86' and the bottom of the upper cap 84', as shown, for preventing upward or downward movement of the clip pin 66' within the barrel 10. Other differences relative to the first embodiment will now be described.

Figure 19:
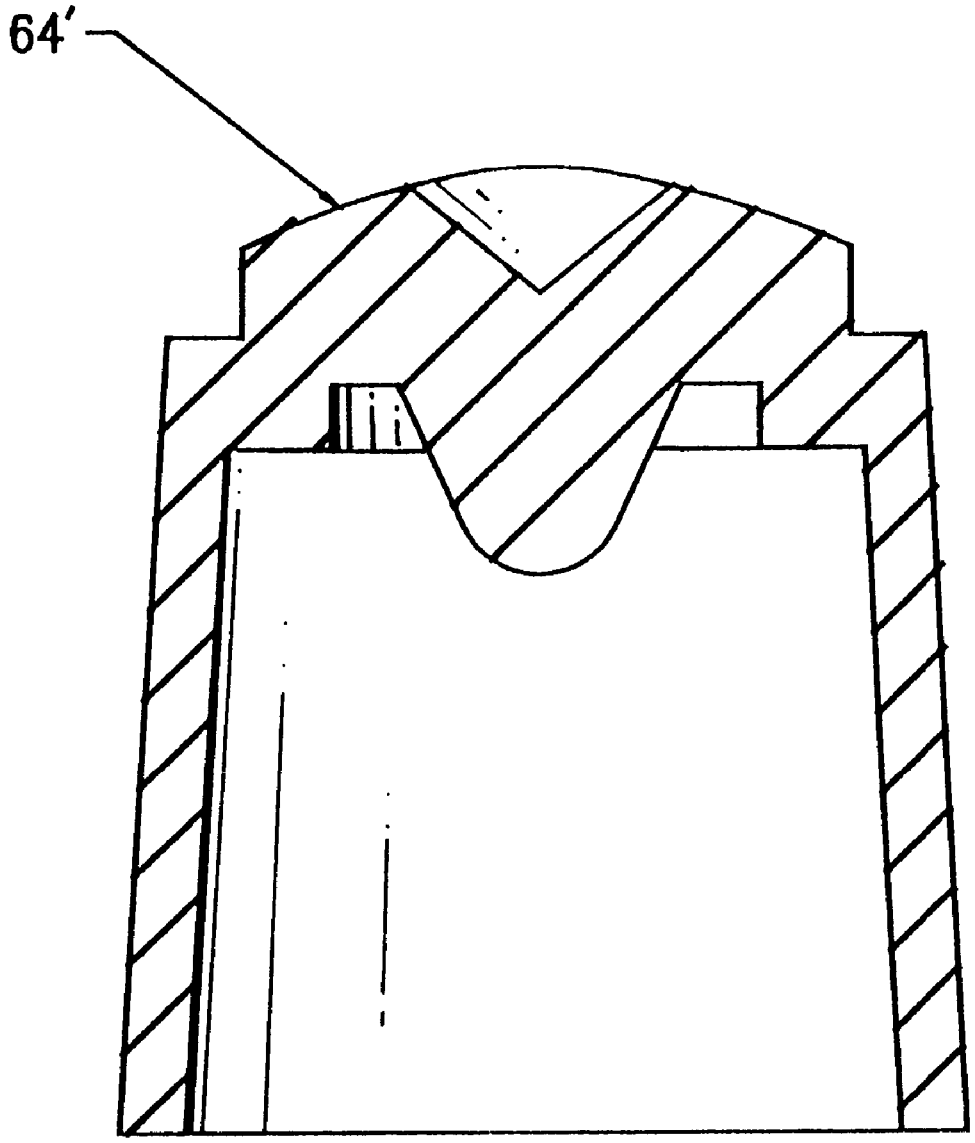
FIG. 19 is a longitudinal cross-sectional view of a rubber boot for the second embodiment of the invention.

With reference to FIG. 12 showing the design of the rubber boot 64 of the first embodiment, relative to FIG. 19 showing the rubber boot design 64' for the second embodiment of the invention, a direct comparison between the two relative to dimensions readily illustrates the differences between the two. In the second embodiment of the invention, the rubber boot 64' is shorter and slightly wider in its upper section, and narrower in its lower section, compared to the rubber boot 64 of the first embodiment. Other differences are readily apparent in comparing the two.

Figure 20C:
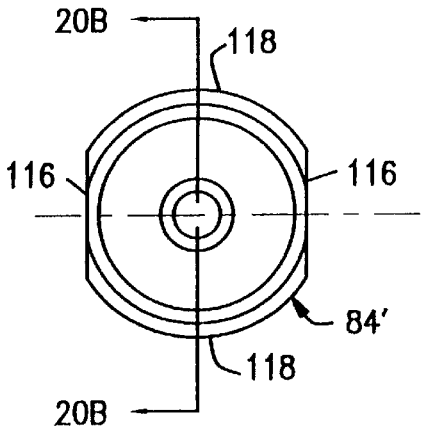
FIG. 20C is a top plan view of the upper cap of FIG. 20A.
Figure 20A:
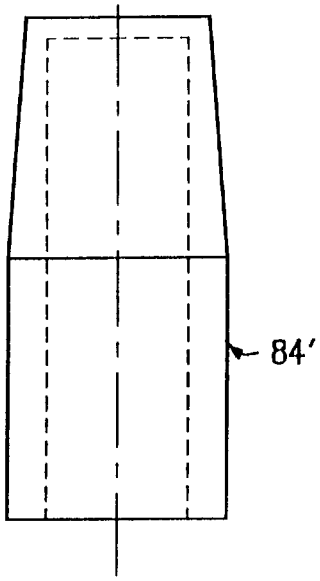
FIG. 20A is a front elevational view of an upper cap for the second embodiment of the invention.
Figure 20B:
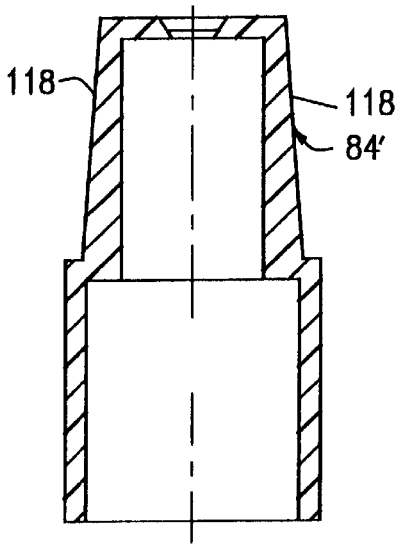
FIG. 20B is a longitudinal cross-sectional view taken along 20B—20B of FIG. 20C of the upper cap of the second embodiment of the invention.
Figure 20D:
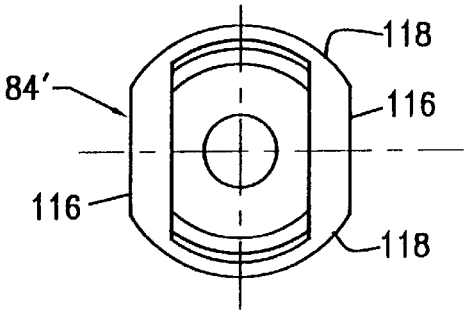
FIG. 20D is a bottom view of the upper cap of FIG. 20A.

The upper plastic cap 84' for the second embodiment of the invention is shown in detail in FIGS. 20A through 20D, showing a front elevational view, a longitudinal cross-sectional view taken along 20B—20B of FIG. 20C, a bottom view, and a plan top view, respectively. A direct comparison between these figures for the second embodiment, and FIG. 13A through 13D for the upper plastic cap 84 of the first embodiment of the invention, clearly illustrates the differences between the two cap designs. Major differences are that in the first embodiment the outside walls of the cap 84 are round, whereas in the second embodiment of the invention the upper cap 84' includes two opposing flat outside wall portions 116, connected by semicircular portions 118. The upper plastic cap 84 of the first embodiment is longer, and has a greater maximum diameter relative to the upper cap 84' of the second embodiment.

With reference to FIGS. 15A through 15D for the lower plastic cap of the first embodiment, relative to FIGS. 22A through 22D for the second embodiment of the invention, a direct comparison readily shows the differences between the two designs. As can be seen, the major difference is in the upper half portion of the two configurations for caps 86, 86', respectively. The upper side portion of the cap 86' for the second embodiment is substantially narrower in one plane than that of the first embodiment in comparing FIG. 22A with FIG. 15B, respectively. Also, a rectangular through hole 102' is located in the center of partition 99', in combination with a dead hole 105' formed by two intersecting rectangular portions 134 and 136. Other differences are apparent in making a direct comparison.

Figure 21C:
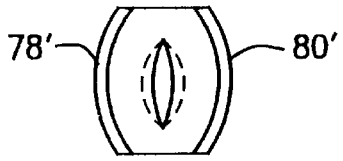
FIG. 21C is a top plan view of the clip pin of FIG. 21B.
Figure 21A:
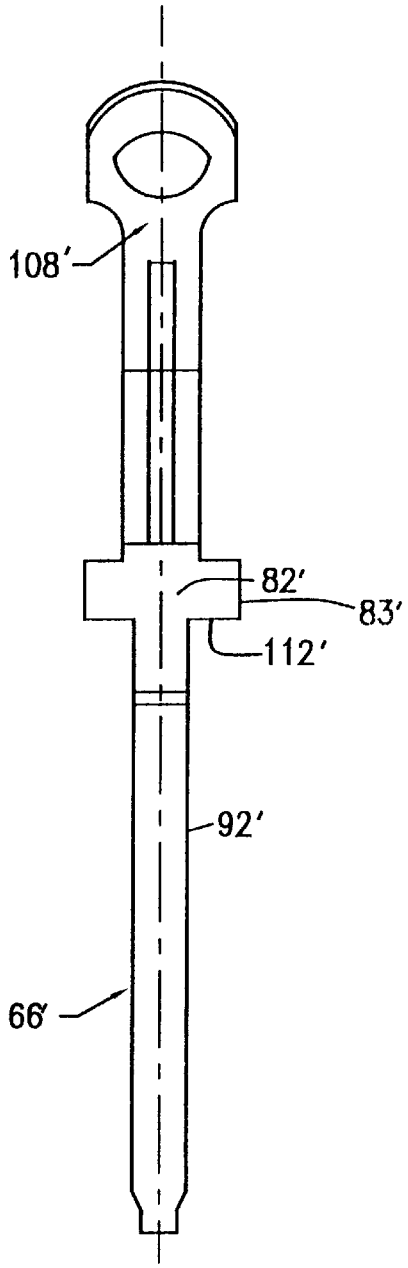
FIG. 21A is a front elevational view of a clip pin of the second embodiment of the invention.
Figure 21B:
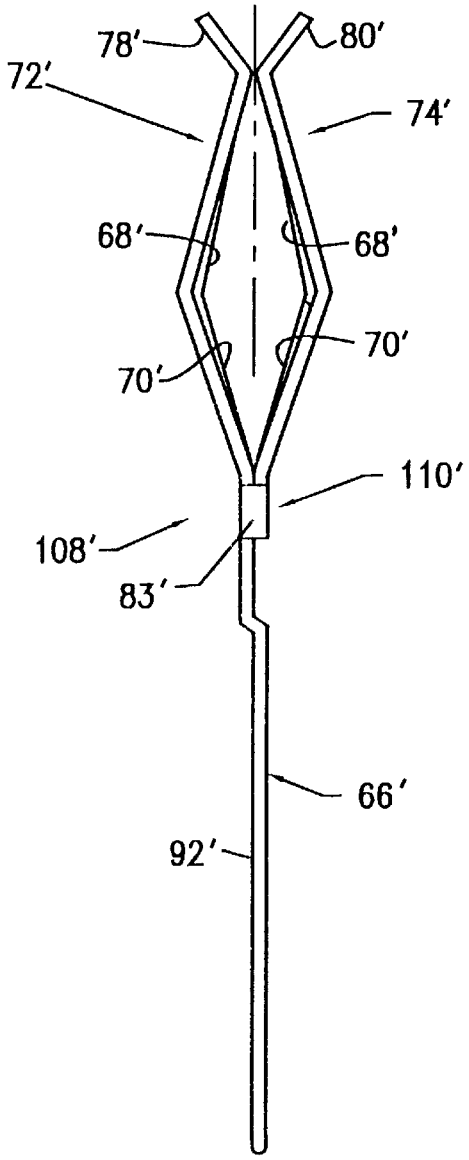
FIG. 21B is a side elevational view of the clip pin of FIG. 21A rotated 90° counterclockwise.
Figure 21D:
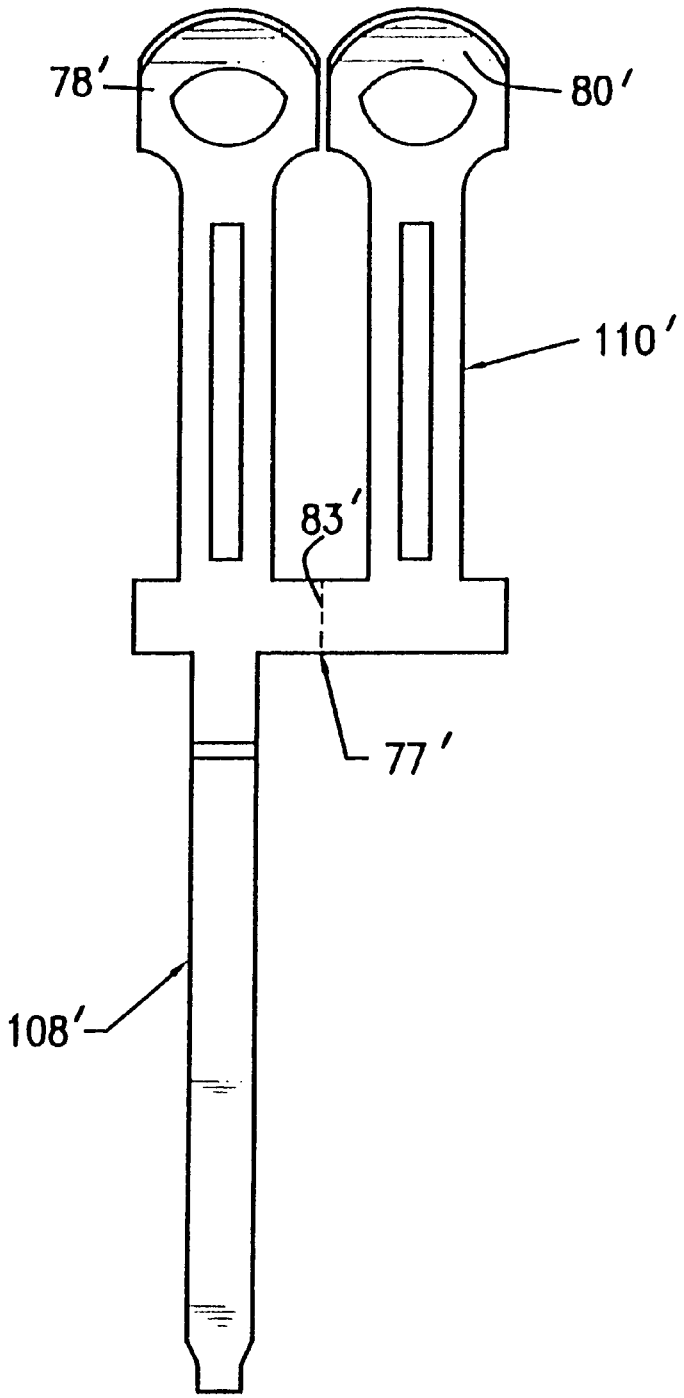
FIG. 21D is a front elevational view of the clip pin of FIGS. 21A through 21C, before bending its two half sections upon one another.
Figure 23A:
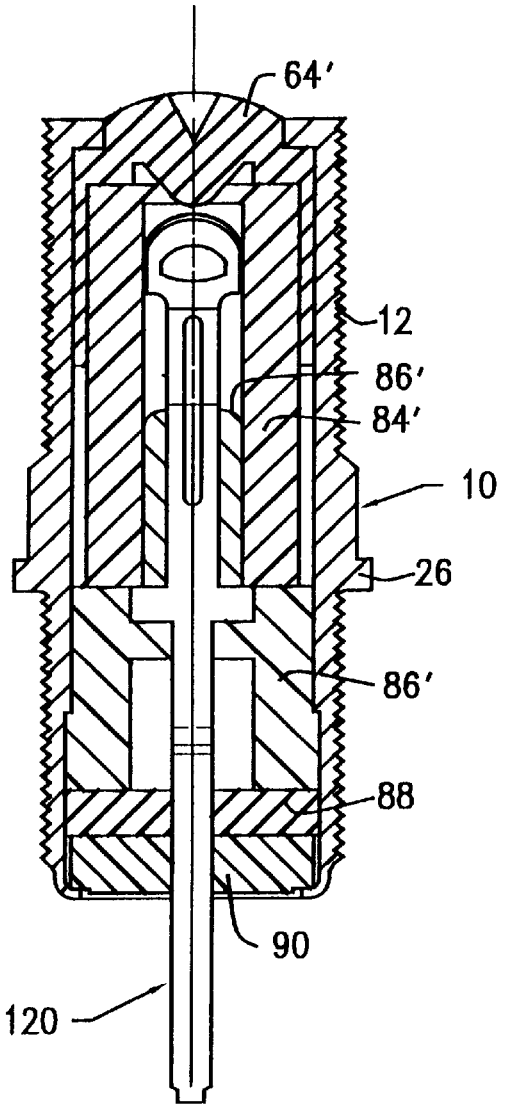
FIG. 23A is a longitudinal cross-sectional view of a hermetically sealed F-connector for a third embodiment of the invention.
Figure 23B:
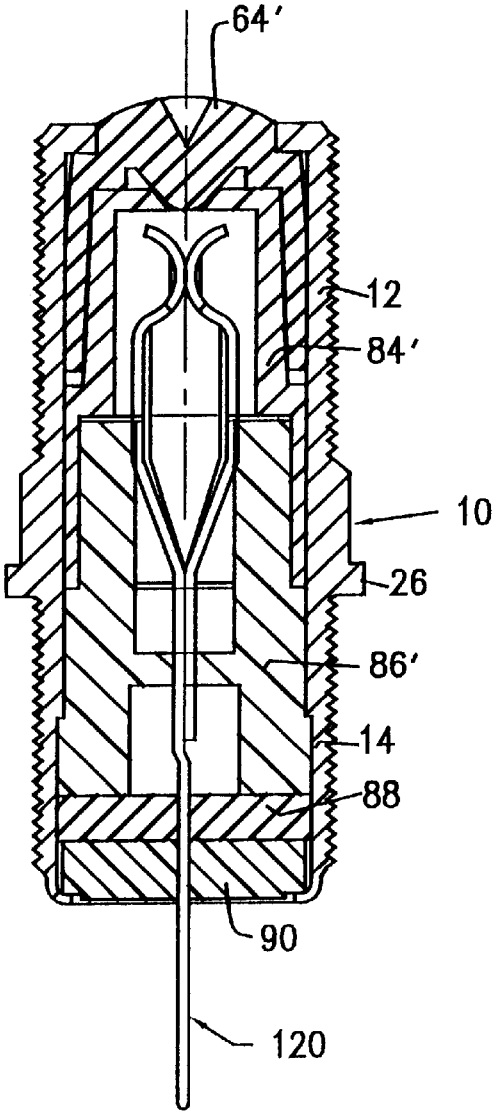
FIG. 23B is a longitudinal cross-sectional view of the hermetically sealed connector of FIG. 23A rotated 90° counterclockwise.
Figure 24C:
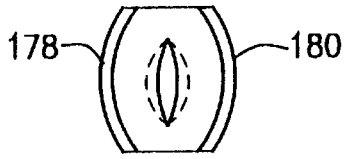
FIG. 24C is a top plan view of the clip pin of FIG. 24B.
Figure 24A:
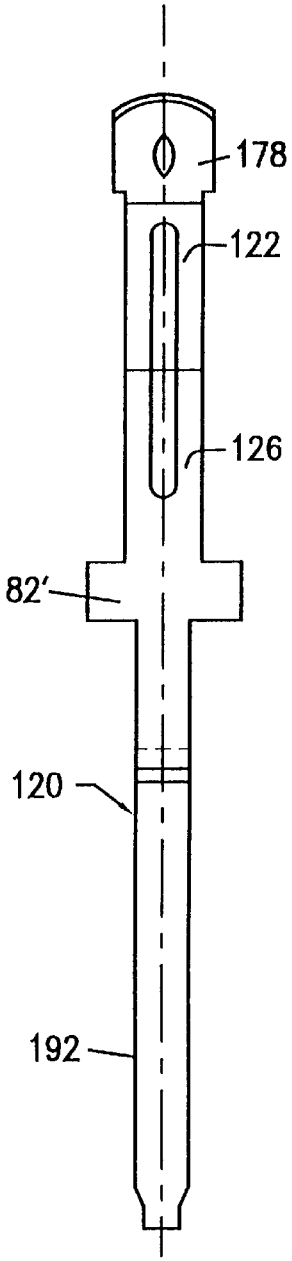
FIG. 24A is a front elevational view of a clip pin of a third embodiment of the invention.
Figure 24B:
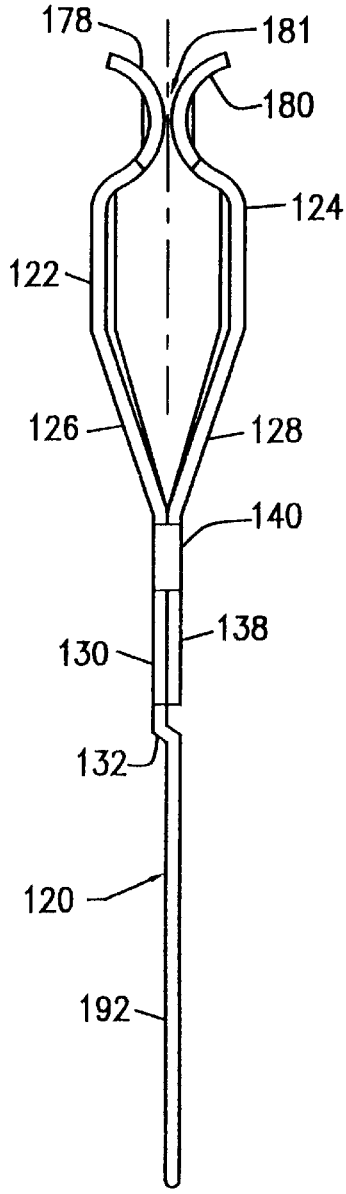
FIG. 24B is a side elevational view of the clip pin of FIG. 24A rotated 90° counterclockwise.
Figure 24D:
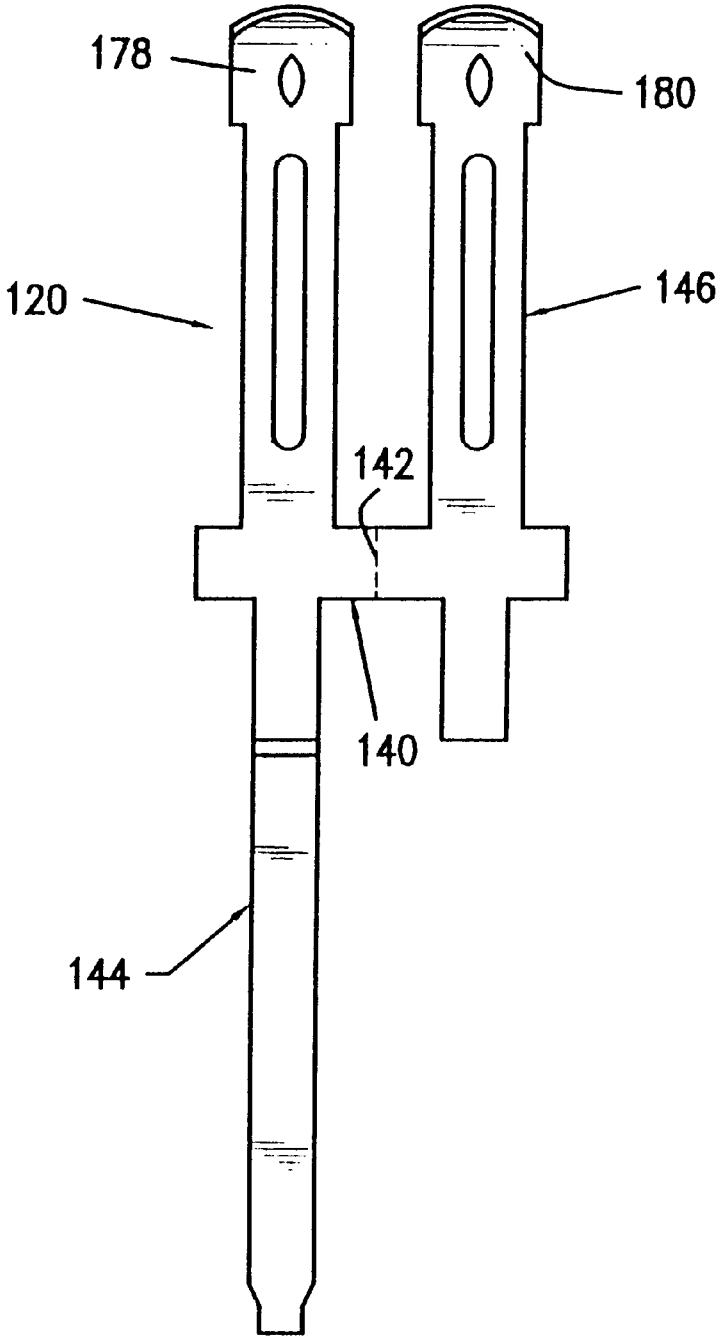
FIG. 24D is a front elevational view of the clip pin of FIGS. 24A, 24B, and 24C, before bending its two half sections upon one another.

The differences between the clip pin 66 design configuration shown in FIGS. 14A through 14C relative to the second embodiment of the invention are readily apparent in comparing the former to the clip pin design 66' of the second embodiment shown in FIGS. 21A through 21C. As previously discussed, a clip pin 66' of the second embodiment includes a modified midportion or section 82' that in conjunction with the design of the upper cap 84' and lower cap 86', provides for the clip pin 66' to be locked in place within the barrel 10, thereby preventing any longitudinal movement. Accordingly, the end tab 76 of the first embodiment is no longer needed in the clip pin 66' of the second embodiment. Similar to clip pin 66, as shown in FIG. 21D, the clip pin 66' is formed from a single piece of material by folding the first and second halves 108' and 110' along bend line 83' of bridge portion 77' connecting the halves, to obtain the configuration of FIG. 24B. The ears 78' and 80' of the second embodiment have a greater angle between their ends, for making it easier for the center conductor of a coaxial cable to be guided therebetween, whereby the ears spring slightly apart for permitting entry of the coaxial cable center conductor therebetween, while insuring electrical contact thereto.

In a third embodiment of the invention, a modified clip pin 120 design is provided as shown in FIGS. 23A through 24C, respectively. Other of the components of the third embodiment of the invention are identical to those of the second embodiment of the invention described immediately above. The major difference in the clip pin 120 of the third embodiment of the invention relative to the clip pin 66' of the second embodiment of the invention is found in the upper portion thereof. In the third embodiment of the invention, the clip pin 120 includes semicircular first and second spring ear contacts 178, 180, respectively, as shown. Note also in the third embodiment, that the portion of the clip pin 120 immediately below the first spring ear 178 is a straight portion 122 that is parallel to the longitudinal axis, and opposing another straight portion 124 extending from the second spring ear 180, as shown. This modification provides increased spring pressure between the abutting ears 178, 180 in comparison to clip pin 66'. The ends of the longitudinally orientated portions 122 and 124 extend into converging opposing portions 126 and 128, respectively, as shown. The material of the lower end of the converging portion 126 is then bent to be longitudinally orientated for forming a portion 130 parallel to the longitudinal axis, the end of which portion is bent or kinked at 132 to lie partially on the longitudinal axis for forming the end portion 192 of the clip pin 120, as shown. The lower end of the converging portion 128 similarly is bent to form a straight portion 138 that is parallel to the longitudinal axis but is cut off before the bend or kink 132 of straight portion 130, as shown. Note in comparing the clip pin 66' of the second embodiment shown in FIG. 21A with the lower portion of the clip pin 120 of the third embodiment as shown in FIG. 24A, that the lower portions have substantially the same design including an identical midsection 82'. Also, similar to clip pin 66, as shown in FIG. 24D, the clip pin 120 is formed from a single piece of material by folding the first and second 20 halves 144 and 146 along bend line 142 of bridge portion 140 to obtain the configuration of FIG. 24B.

The purpose of the modified clip pin 120 of the third embodiment of the invention is to increase the contact surface area of the spring ears 178 and 180 in region 181 where they abut against one another, and impose against the end of the center conductor of a coaxial cable that is positioned therebetween. In comparison to the spring ears 78 and 80 of the embodiment of FIG. 14B, which each only provide a point contact along corner edges 79, 81, respectively, against the center conductor of a coaxial cable therebetween, the spring ears 178 and 180 by being semicircular provide a substantially greater contact surface area against the coaxial cable center conductor. In this manner, a more reliable electrical connection between the clip pin 120 and the center conductor of the coaxial cable is obtained, relative to the first and second of the embodiments of the invention.

Although various embodiments of the invention have been shown and described herein, they are not meant to be limiting. Those of skill in the art may recognize various modifications to these embodiments, which modifications are meant to be covered by the spirit and scope of the appended claims. For example, in the preferred embodiment, the clip pin 66 of the first embodiment, 66' of the second embodiment, and 120 of the third embodiment consist of phosphor bronze material that is tin plated. However, other suitable materials may be used. In addition, although various embodiments of the invention have been described for use in F-connectors in association with coaxial cables, such description is meant for purposes of illustration, and not meant to be limiting. The various embodiments of the present invention can be extended for use with many different types of coaxial-cable connectors, whether 75 ohm or 50 ohm, or some other impedance. Also, the first and second caps shown for use in the various embodiments of the invention can be combined in certain applications as a single cap. However, the use of two caps typically provides for easier assembly of the connector in comparison to using one cap. Note further that the dimensions given herein are for purposes of illustration, and not meant to be limiting. Depending on the application, other dimensions may be used.

Figure 25B:
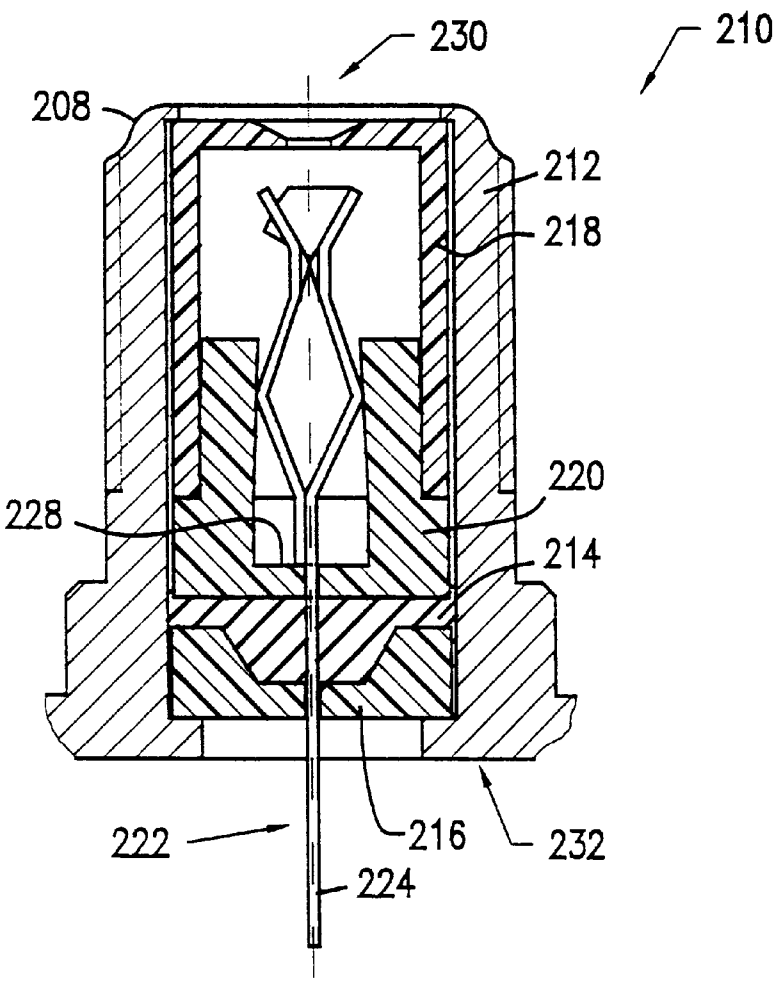
FIG. 25B is a longitudinal cross-sectional view of the connector of FIG. 25A after peening over housing end to retain the connector components unde compression.
Figure 25A:
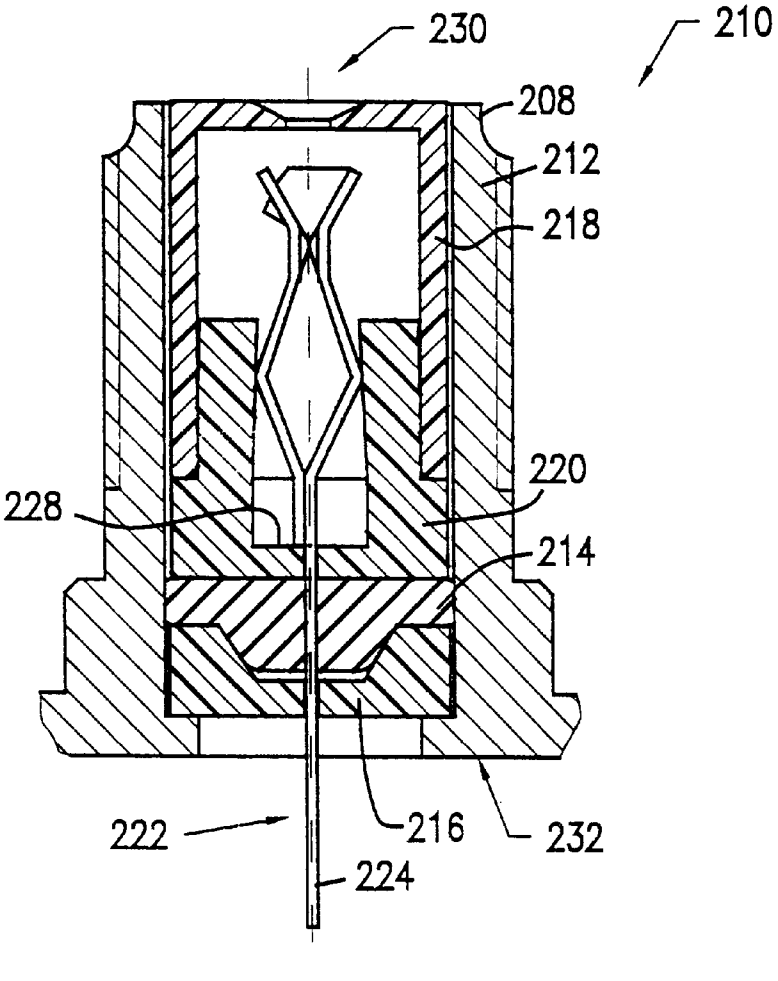
FIG. 25A is a longitudinal cross-sectional elevational view of a hermetically sealed F-connector for a fourth embodiment of the invention before securing the connector components.

In a fourth embodiment of the invention, as shown in FIGS. 25A through 32D, an alternative preferred embodiment hermetically sealed F-connector 210 is shown. With reference to FIGS. 25A and 25B, as to the basic configuration, the components of this embodiment is similar to the like components of the preceding embodiments of the invention as previously described except for a number of improvements. It is emphasized that the design philosophy as presented previously between the various embodiments of the invention is applicable herein as well.

FIG. 25A shows the connector 210 with the connector components located therein. FIG. 25B shows the same assembled connector with a top edge portion 208 of barrel 212 being rolled over to maintain the components under compression for secure retainment and to create a hermetic seal against passage of moisture through the connector 210 as will be described hereinafter.

Similar to the third embodiment of the invention, the fourth embodiment also includes a barrel 212 consisting of an electrically conductive material, a resilient washer 214, a washer 216 consisting of a rigid dielectric material, an upper cap 218, a lower cap 220, a clip pin 222 having an end portion 224. Like the third embodiment described immediately above, the widened central portion 226 (as shown in FIG. 26A) of the clip pin 222 is captively held between a bottom inside face 228 of the lower cap 220 and the bottom of the upper cap 218, as shown, for preventing upward or downward movement of the clip pin 222 within the barrel 212.

The barrel 212 differs from the barrel described in previous embodiments, in that the threaded portions 12 and 14 and the protrusion 26 dividing the two portions 12 and 14 of the earlier third embodiment, is absent from the exterior sidewalls (see FIG. 11). However, in certain applications, such features may be included on the present connector 210. The present configuration permits a lower edge portion 232 of the connector 210 to be formed integral with a main housing structure through a method of integral casting. However, it is old in the art to have integral casting of connector ports with the main housing structure.

Additional differences between the present embodiment and the third embodiment include the absence of the rubber boot 64'. However, it also is noted that the rubber boot 64' as described above may be incorporated into this embodiment for certain applications. In the present embodiment, the upper cap 218 is in direct contact with the top edge portion 208 of the barrel 212 (see FIG. 25B) for receiving a compressive force therefrom. The center conductor of a coaxial cable enters the connector 210 through the central opening 230 of the upper cap 218. Other differences relative to the connector components of previous embodiments will be described.

Figure 26A:
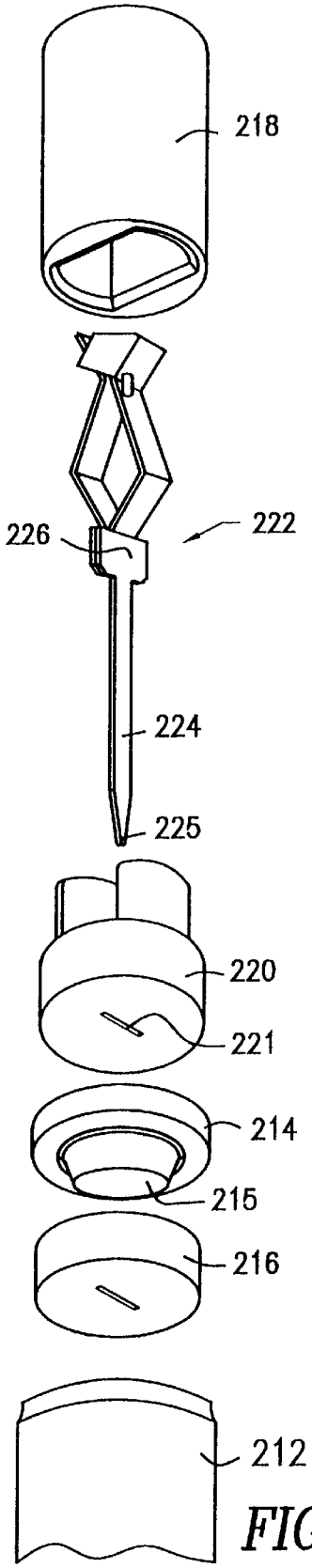
FIG. 26A is an exploded assembly diagram of the connector as viewed from below of FIGS. 25A and 25B absent the barrel or outer housing before being incorporated thereinto.
Figure 26B:
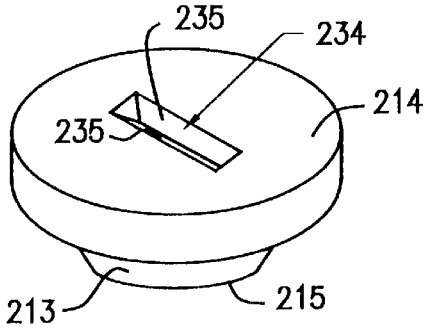
FIG. 26B is a pictorial view of a resilient washer shown in FIG. 26A viewed from above.

With reference to FIG. 26A, an exploded assembly diagram viewed from a lower perspective is shown for the fourth embodiment of the invention. The rigid dielectric material washer 216 is first inserted through an opening at the upper end of the barrel 212. Next, the resilient washer 214 is oriented as shown and pushed into the barrel 212 for nesting-like engagement with the inserted rigid dielectric material washer 216, as will be described. Next, the end portion 224 of the clip pin 222 is inserted through a central rectangular hole 221 of the lower cap 220 until the wide portion 226 of the clip pin hits the bottom inside face 228 of the lower cap 220 (see FIG. 25B). The lower cap 220 with the clip pin 222 therein, is then pushed into the upper cap 218 for engagement therewith as shown. The cap and clip pin 218, 220, 216 assembly is inserted lower cap first through the opening at the upper end of the barrel 212. The end portion 224 of the clip pin 222 penetrates a centrally located rectangular 234 (see FIG. 26B) of the resilient washer 214 for piercing through a downwardly tapered circular protrusion 215. Finally, the end portion 224 of the clip pin 222 passing through a rectangular hole 236 (see FIG. 26C) in the rigid washer 216, exits the barrel 212 therebelow. Pressure is then applied to the upper cap 218, and the top edge portion 208 of the barrel 212 is rolled over to retain the assembly under compression and in combination with the rigid washer 216 for forcing the resilient washer 214 against interior wall portions of the barrel 212 (as shown in FIG. 25B), and also to compress the rectangular hollow 234 and center of the resilient washer 214 to hermetically seal around the end portion 224 of the clip pin 222. In this manner, the resilient and rigid washers 214 and 216, in combination, provide a positive hermetic seal to prevent moisture from passing through the interior of the connector 210 (see FIG. 25B). Alternatively, depending on the application, the barrel 212 may be such that the above-mentioned components may be inserted through the bottom end of the barrel 212 in the reverse order with the lower edge portion 232 having a peening ring, instead of the top edge portion 208, being peened over the edge of the rigid washer 216 to retain the assembly under pressure in a manner similar to the previously described embodiments, with the top edge portion 208 formed to retain the components.

With reference to FIGS. 16A and 16B showing the design of the resilient washer 88 of the previous embodiments, relative to FIGS. 26A, 26B and 28A through 28C showing the resilient washer 214, a direct comparison between the two washers illustrates the major differences between the two. In the present embodiment of the invention, the disk-shaped resilient washer 214 further includes a downwardly tapered circular protrusion 215 extending from the bottom thereof. The sidewall portion 213 converges from the bottom of the washer 214 to the end portion of the protrusion 215. The protrusion 215 is configured to partially fit into the rigid washer 216 as will be described. As shown in the cross-sectional view of FIG. 28B, the top of the resilient washer 214 includes a centrally located rectangular depression 234 which further includes converging side portions 235 from the top of the v-shaped depression 234 to a halfway depth in the resilient washer 214, for assisting assembly. Differing from the resilient washer 88 of previous design (see FIG. 16A), no throughhole is provided. During assembly, the end portion 224 of the clip pin 222 physically pierces through the body of the resilient washer 214 below the depression 234. With this design, a tighter and more conforming fit around the clip pin 222 is thereby provided.

Figure 26C:
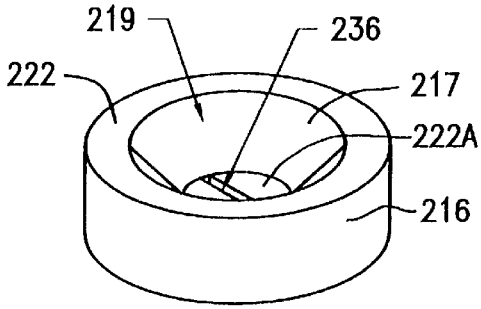
FIG. 26C is a pictorial view of a rigid dielectric material washer shown in FIG. 26A viewed from above.
Figure 27A:
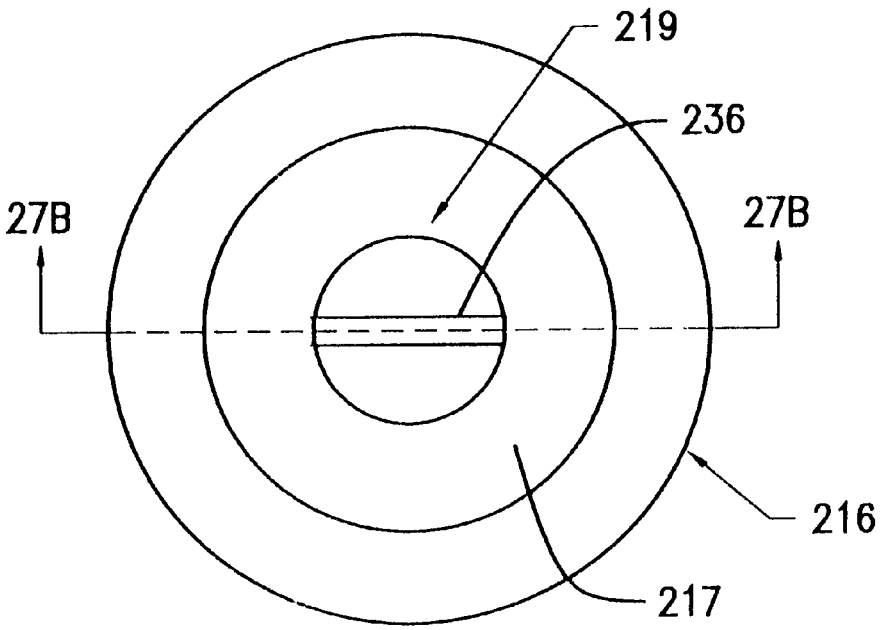
FIG. 27A is a plan top view of the rigid dielectric material washer.
Figure 27B:
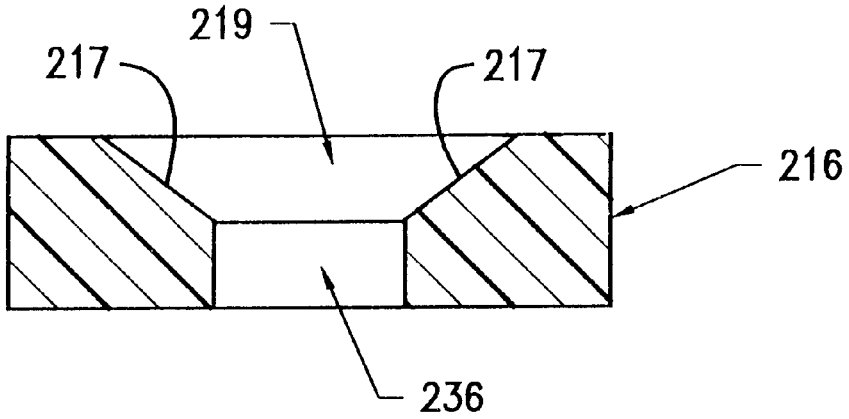
FIG. 27B is a cross-sectional elevational view taken along 27B—27B of FIG. 27A of the rigid dielectric material washer.
Figure 28A:
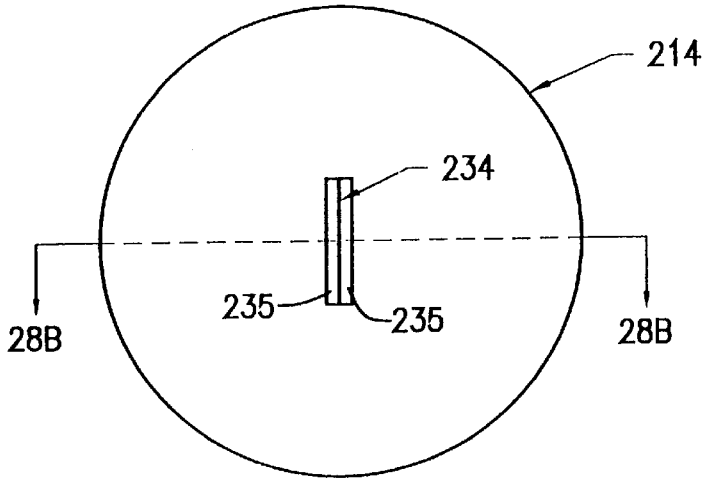
FIG. 28A is a plan top view of the resilient washer.
Figure 28B:
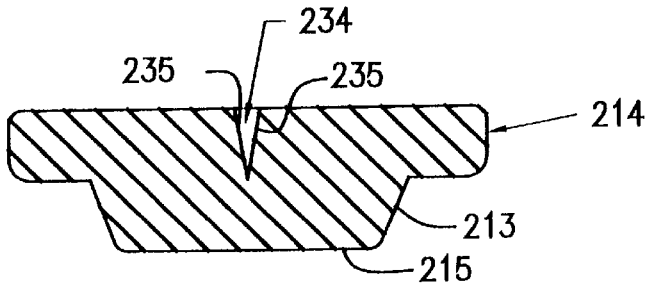
FIG. 28B is a cross-sectional elevational view taken along 28B—28B of FIG. 28A of the resilient washer.
Figure 28C:
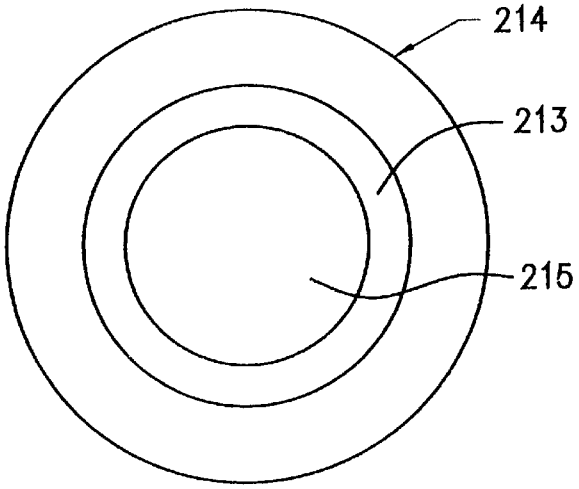
FIG. 28C is a bottom view of the resilient washer of FIG. 28B.

With reference to FIGS. 17A through 17C showing the design of the rigid washer 90 of the previous embodiments, relative to FIGS. 26A, and 26C showing the rigid washer 216, a direct comparison between the two washers illustrates the differences between the two. In the present embodiment of the invention, the rigid washer 90 is a substantially cylindrical component. A circular depression 219 includes converging sidewalls 217, is disposed along the top surface thereof. A top rim portion 222 circumscribes the circular depression 219. The circular depression 219 is configured for receiving in tight fitting engagement the circular tapered protrusion 215 of the resilient washer 214. A centrally located rectangular hole 236 is provided therein through which the end portion 224 of the clip pin 222 passes through and out of the assembled connector 210.

Under compression, the sidewall portions 217, bottom portion 222A, and the rim 222 to of the rigid washer 216 press against the sidewall 213 of the protrusion 215 and bottom of the resilient washer 214 form a tight hermetic seal therebetween. The compressive force exerted by the rigid washer 216 against the resilient washer 214 causes the resilient washer 214 to deform and press against the interior wall portions of the barrel 212 and around the end portion 224 of the clip pin 222 (as shown in FIG. 25B) thereby forming a tight hermetic seal to create a barrier against moisture passage. Other differences are readily apparent in comparing the washers of the previous and the present embodiments.

Figure 29A:
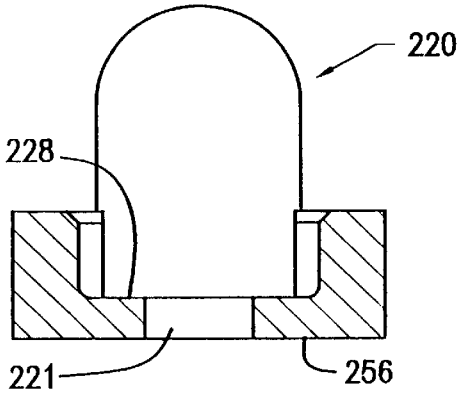
FIG. 29A is a longitudinal cross-sectional view taken along 29A—29A of FIG. 29C for a lower cap for the fourth embodiment of the invention.
Figure 29B:
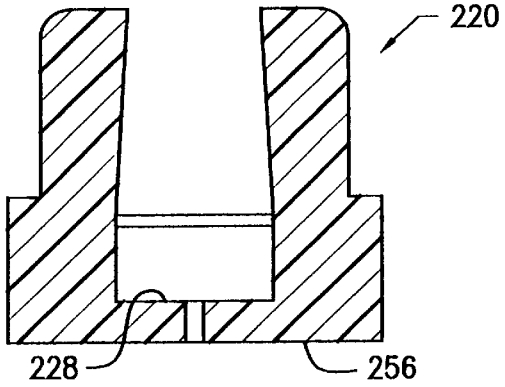
FIG. 29B is a longitudinal cross-sectional view taken along 29B—29B of FIG. 29C for a lower cap for the fourth embodiment of the invention.
Figure 29C:
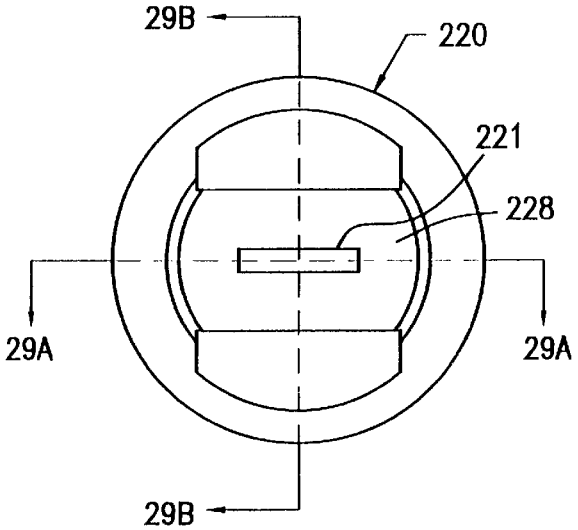
FIG. 29C is a top plan view of the lower cap of FIG. 29A.
Figure 29D:
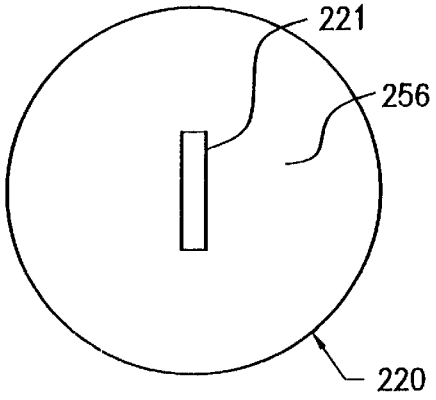
FIG. 29D is a bottom view of the lower cap of FIG. 29A.

The lower cap 220 for the fourth embodiment of the invention is shown in detail in FIGS. 29A through 29D, showing a longitudinal cross-sectional view taken along 29A—29A of FIG. 29C, a longitudinal cross-sectional view taken along 29B—29B of FIG. 29C, a top plan view, and a bottom view, respectively. A direct comparison between these figures for the fourth embodiment, and FIGS. 22A through 22D for the lower cap 220 of the second embodiment, clearly illustrates the differences between the two cap designs. One major difference is that in the second embodiment of the lower cap 86', the lower portion is provided for this configuration (as shown in FIGS. 22A and 22B), is different in the lower cap 220 of the present embodiment. In this embodiment (see FIG. 29A), the bottom 256 of the lower cap 220 is substantially flat and provides a uniform surface for a more even distribution of compressive force against the top face of the resilient washer 214.

Figure 30A:
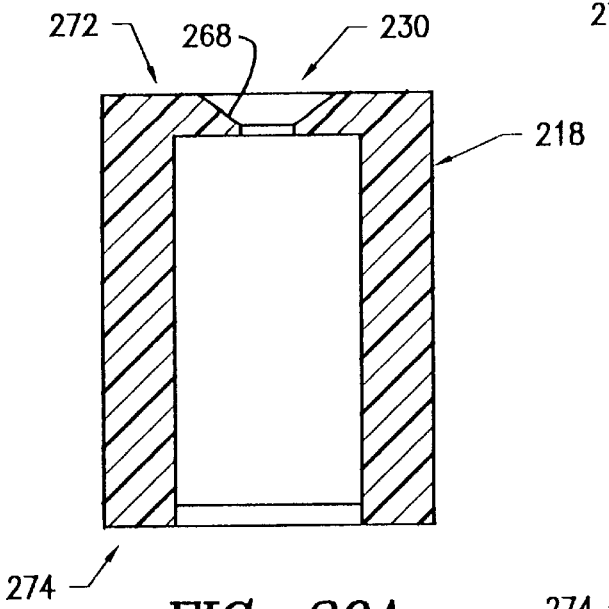
FIG. 30A is a longitudinal cross-sectional view taken along 30A—30A of FIG. 30C for an upper cap for the fourth embodiment of the invention.
Figure 30B:
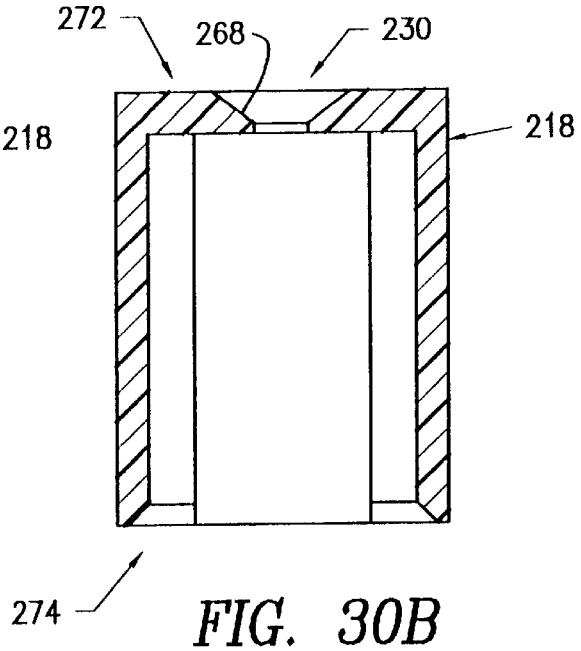
FIG. 30B is a longitudinal cross-sectional view taken along 30B—30B of FIG. 30C for an upper cap for the fourth embodiment of the invention.
Figure 30C:
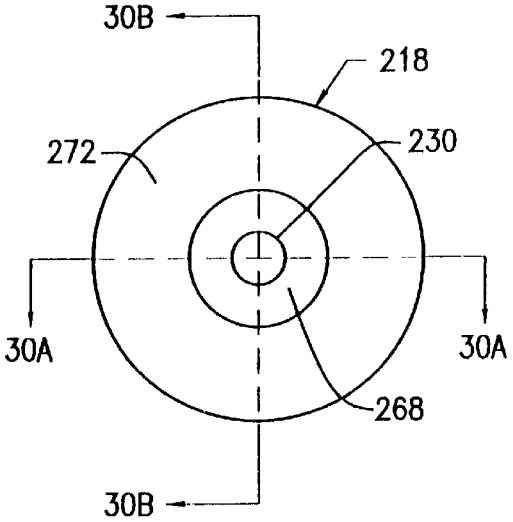
FIG. 30C is a top plan view of the upper cap of FIG. 30A.
Figure 30D:
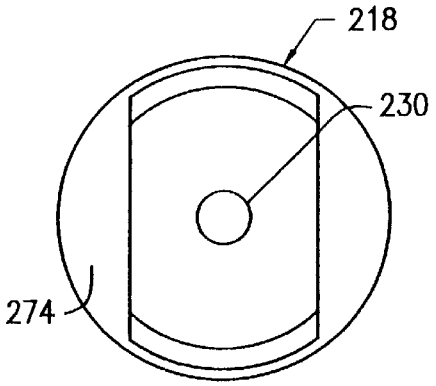
FIG. 30D is a bottom view of the upper cap of FIG. 30A.

With references to FIGS. 20A through 20D for the upper cap of the second embodiment, relative to FIGS. 30A through 30D for the fourth embodiment of the invention, a direct comparison readily shows the differences between the two designs. The basic configurations of the two designs are similar. Major differences are that in the presently preferred embodiment the outside walls of the upper cap 218 are round, whereas in the second embodiment of the invention the upper cap 84' includes two opposing flat outside wall portions 116, connected by semicircular portions 118. Further, the upper cap 84' includes an upper portion with diverging sidewalls, and parallel sidewalls for a widened lower portion providing a stepped appearance, while the upper cap 218 of the present embodiment, includes corresponding parallel sidewalls of uniform thickness from the top to the lower end thereof as best shown in FIGS. 30A and 30B.

Figure 31:
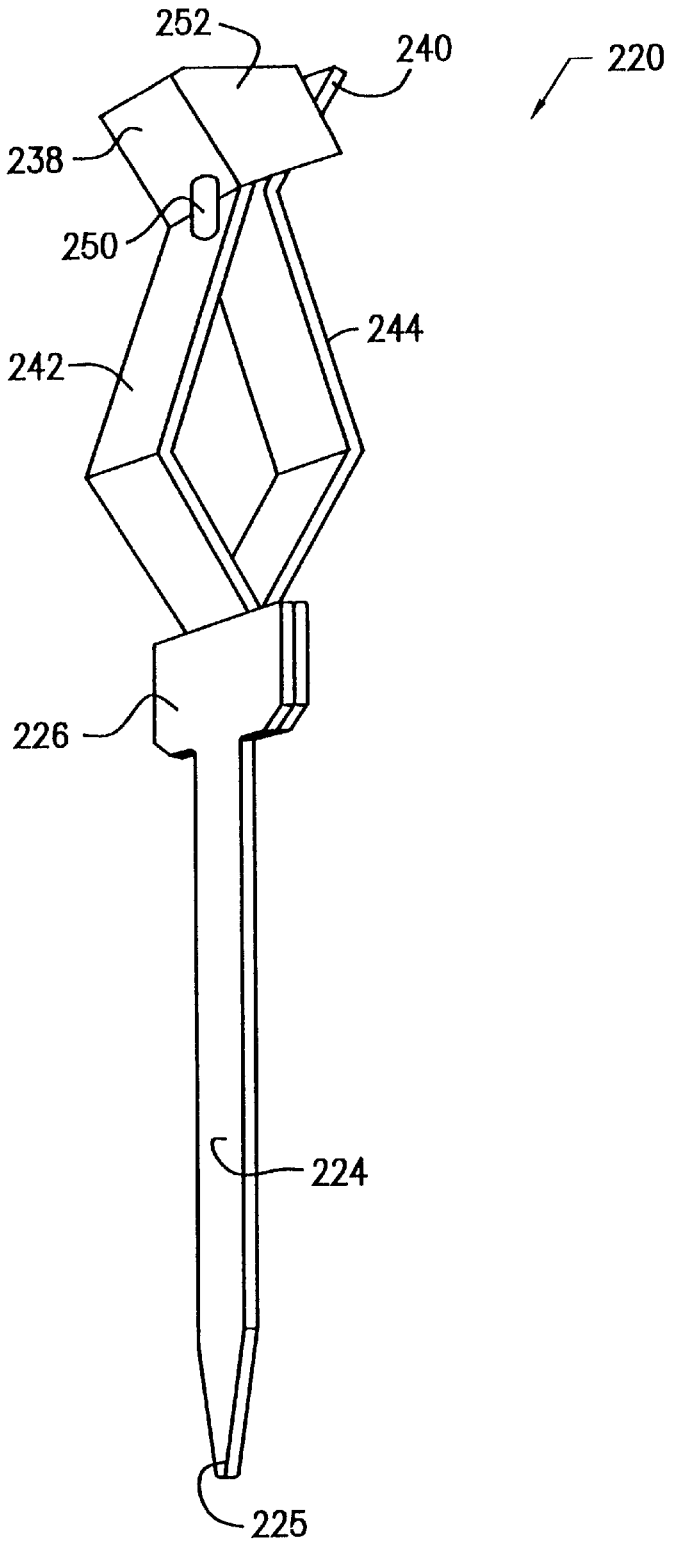
FIG. 31 is a pictorial view of a clip pin of the fourth embodiment of the invention.
Figure 32A:
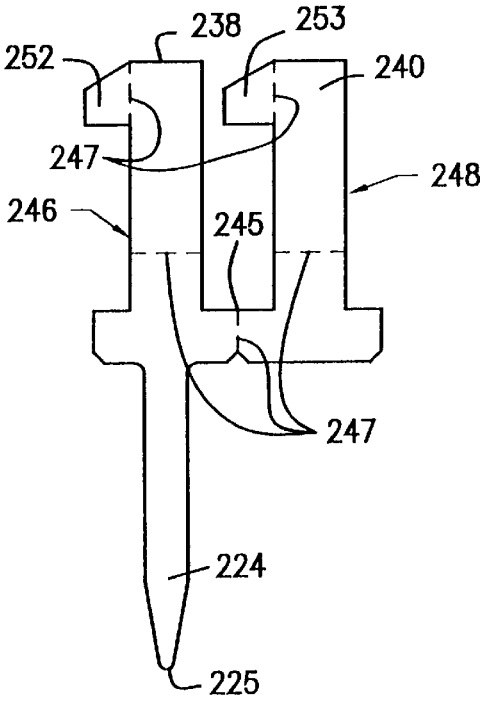
FIG. 32A is a front elevational view of the metallic stamping of the clip pin of FIG. 31, before bending its two half sections upon one another.
Figure 32B:
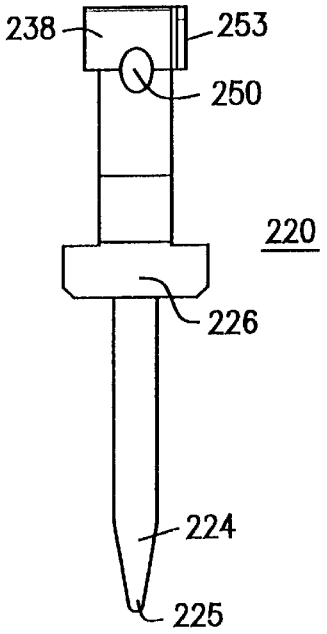
FIG. 32B is a front elevational view of the clip pin of FIG. 32A, after bending various sections to form the finished clip pin.
Figure 32C:
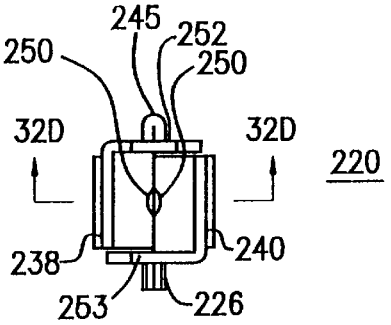
FIG. 32C is a top plan view of the clip pin of FIG. 32B.
Figure 32D:
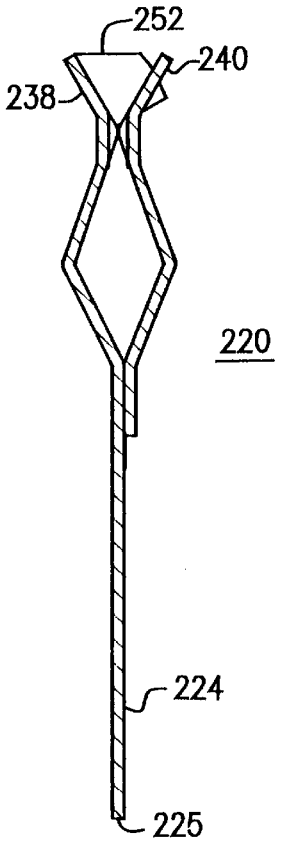
FIG. 32D is a longitudinal cross-sectional view taken along 32D—32D of the clip pin of FIG. 32C.

Finally, in the this preferred embodiment of the invention, a modified clip pin 220 design is provided as shown in FIGS. 25A, 25B, 26A, 31, and 32A through 32D, respectively. Referring specifically to FIG. 31, the clip pin 220 is similar in most respect to the previously described clip pin design embodiments. Like previous embodiments, the clip pin 220 includes constructing the end portion 224 from a single piece of material. The clip pin 220 also includes opposing V-shaped portions 242 and 244 similar to the first and second embodiments. As shown in FIG. 32A, the clip pin 220 like the clips pins of previous embodiments, is formed from a single piece of material by folding the first and second halves 246 and 248 along bend lines 245 of bridge portion 247, to obtain the configuration of FIGS. 32B, 32C, and 32D.

Like the clip pin 120 (see FIG. 24A) of the third embodiment, a semicylindrical contact surface 250 is provided between the spring ear contact 238, 240 and the V-shaped portion 242, 244 (see FIG. 31). The purpose of the semicylindrical contact surface is to increase the contact surface area of the contact ears 238 and 240 at the region where they abut against one another, and impose against the end of the center conductor of a coaxial cable that is positioned therebetween. In comparison to the spring ear contacts of the embodiments shown in FIG. 14B, which provide only a point contact along the corner edges 79, 81, respectively, against the center conductor of a coaxial cable therebetween. In the present embodiment, the ear contacts 238 and 240, by having semicylindrical contact areas, provide a substantially greater contact surface area with the coaxial cable center conductor. In this manner, a more reliable electrical connection between the clip pin 220 and the center conductor of the coaxial cable is obtained, relative to the first and second embodiments of the invention as shown in FIG. 14B.

The major differences in the clip pin 220 of the fourth embodiment of the invention, however, is found in the upper and lower portions thereof. At the lower portion, the end portion 224 of the clip pin 220 includes a sharpened tip 225. The sharpened tip 225 permits the end portion 224 to pierce through the body of the resilient washer 214 at the centrally located rectangular depression 234 during assembly, as mentioned above. At the upper portion, each ear contact 238 and 240 includes a flap portion 252 and 253, respectively, extending along a side edge portion, as shown best in FIGS. 31, 32C and 32D. As the conductor is inserted into the connector, the flap portions 252 and 253 guide the conductor tip as it advances between the contact ears 238 and 240, and ensure proper alignment and contact between contact ears 238 and 240 of the clip pin 220, and the center conductor of the coaxial cable (not shown).

It should be again noted that various components including the clip pin 220 of the preferred embodiment are not to be limited for use only in the present embodied F-connector and may be incorporated into other previous connector designs for various applications. In addition, the various embodiments of the present invention can be extended for use with many different types of coaxial-cable connectors, whether 75 ohm or 50 ohm, or some other impedance. Depending on the application, other dimensions than any discussed or illustrated herein may be used.

Figure 33A:
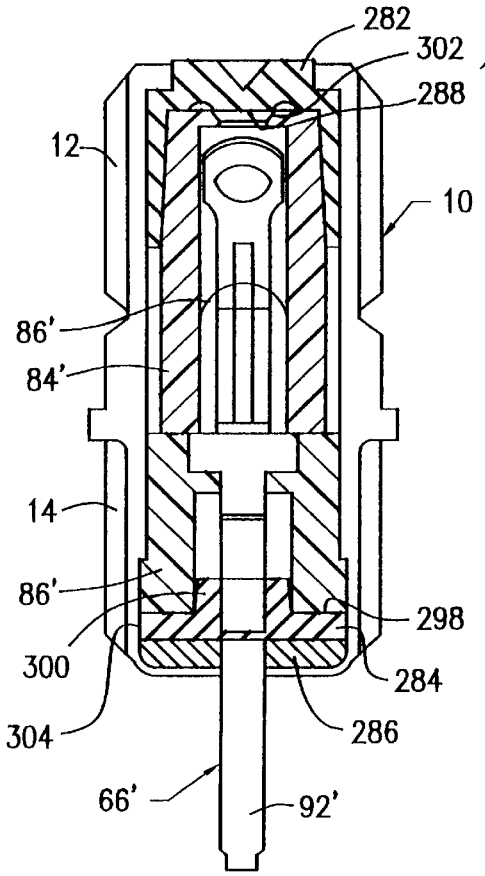
FIG. 33A is a longitudinal cross-sectional elevational view of a hermetically sealed F-connector for fifth and sixth embodiments of the invention.
Figure 33B:
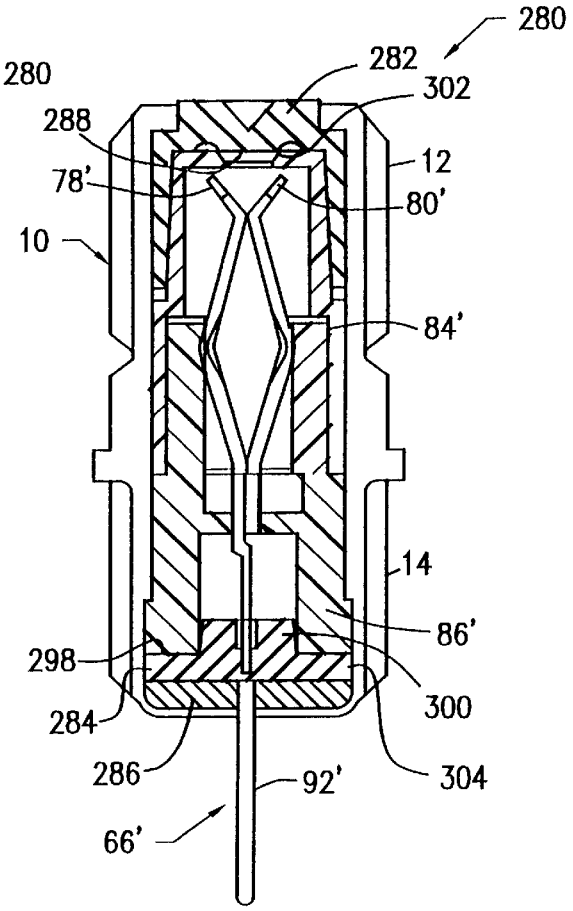
FIG. 33B is a longitudinal cross-sectional view of the hermetically sealed connector of FIG. 33A rotated 90° counterclockwise.

In FIGS. 33A and 33B, fifth and sixth embodiments of the invention are shown, for a preferred hermetically sealed F-connector 280. Only the barrel 10, upper cap 84', lower cap 86', and clip pin 66' are substantially identical to the like components of the second embodiment of the invention previously described. However, the design philosophy between the various embodiments of the invention presented herein remain similar. Similar to the second embodiment of the invention, the fifth and sixth embodiments also includes a rubber boot 282, a resilient washer 284, and a rigid washer 286, as shown in FIGS. 33A and 33B.

Figure 34:
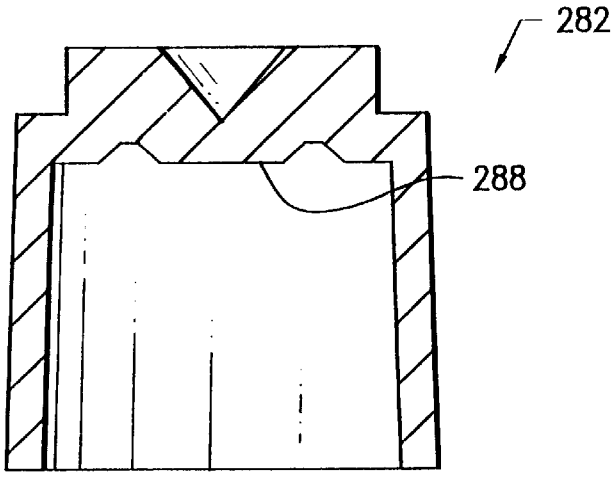
FIG. 34 is a longitudinal cross-sectional view of a rubber boot for the fifth embodiment of the invention.
Figure 35A:
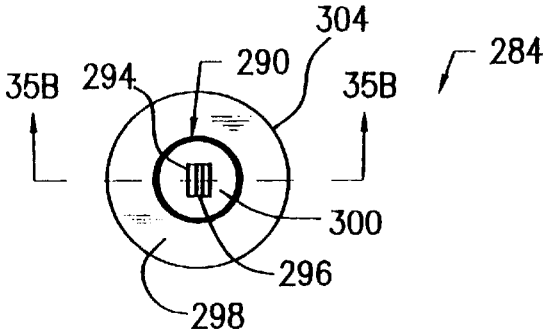
FIG. 35A is a top plan view of a rubber washer of the sixth embodiment of the invention.
Figure 35B:
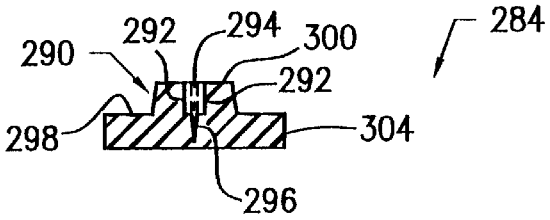
FIG. 35B is a cross-sectional view taken along 35B—35B of FIG. 35A for the rubber washer.

In the fifth embodiment of the invention, a modified resilient boot 282 design is provided as shown in FIGS. 33A through 34. The major difference in the resilient boot 282 of the fifth embodiment relative to the rubber boots 64 and 64' of the previous embodiments of the invention is found in the midsection thereof. In the fifth embodiment of the invention, the resilient boot 282 includes a stepped midsection 288 as shown. The conical midsection of the rubber boots 64 and 64' is prone to breakage when improperly cut center conductors are inserted through the input port 4. Pieces of the boot 64, 64' then become lodged between the center conductor and the spring ear contacts 78' and 80' interfering with proper electrical communication. The resilient boot 282 avoids this problem by minimizing the downwardly projecting conical portion at the midsection. This modification provides the boot 282 with an increased resistance to breakage while preserving contact with the beveled edge portion of a centrally located hole 302 in the upper cap 84' for biasing the stepped midsection 288 inward against the center conductor. Like the rubber boots 64 and 64', the resilient boot 282 may be fabricated from rubber material or any other suitable ductile and deformable material.

In a sixth embodiment of the invention, a modified resilient washer 284 design is provided as shown in FIGS. 33A, 33B, 35A and 35B. The major difference in the resilient washer 284 of the sixth embodiment of the invention relative to the resilient washer 88 of the first, second and third embodiments of the invention is found in the upper portion thereof. In the sixth embodiment of the invention, the resilient washer 284 includes a circular stepped portion 300 extending vertically from a central top face surface 298 thereof. Note also in the sixth embodiment, that a centrally located rectangular hole 294 extends from the stepped portion 300 to a halfway depth in the resilient washer 214. The resilient washer 88 of the previous design, does not include a hole such as hole 294. The upper portion of the hole 294 includes parallel sidewalls 292, while the lower portion 296 of the hole 294 includes converging side portions for assisting assembly. During assembly, the end portion 92' of the clip pin 66' physically pierces through the body of the resilient washer 284 below the hole 294. With this design, a tighter and more conforming fit is established around the clip pin 66'.

Like the rubber washers 88 of the previous design, the resilient washer 284 of the sixth embodiment includes a sidewall portion 304 which seals against the inner sidewalls of the barrel 10. Also a top face 298 of the resilient washer 284 seals against the lower portion of the lower cap 86' when the resilient washer 284 is under compression. However, absent in previous embodiments, the sixth embodiment further includes the circular stepped portion 300 which extends into the hollow core of the lower cap 86' where a sidewall portion 290 makes contact with the inner wall of the lower cap 86' for creating a moisture seal therein. In this preferred embodiment, an improved moisture barrier is achieved over the previously described alternative embodiments for a rubber washer.

A minor difference in the rigid washer 286 of this embodiment of the invention relative to the rigid washer of the 90 of the previous embodiments of the invention is found in the lower portion thereof. The rigid washer 90 includes a lower portion with a smaller diameter than the upper portion thereof as shown best in FIGS. 17A, 18A and 18B, for example. Without creating any functional differences, the rigid washer 286 of the present embodiment foregoes this lower portion in its design. This modification is made in the interest of simplifying the fabrication of the rigid washer 286.

What is claimed is:

1. A hermetically sealed female connector for a coaxial cable, comprising:

a barrel-shaped housing having a top end with a centrally located hole forming an input port, at least a threaded upper portion proximate the input port, an open bottom end, and a hollow cylindrical cavity between said top and bottom ends;

a boot consisting of relatively ductile and deformable material having a memory, said boot having a circular cross-section, a closed top portion, diverging sidewalls extending from said top portion, and a hollow interior cavity, said boot being positioned within said housing with the top portion of said boot configured to slightly protrude from the centrally located hole in the top end of said barrel;

a cap member having a hollow core, and upper portion configured to fit within said boot, and a lower portion extending from said boot toward the bottom end of said housing, said cap member being responsive to an upward force;

washer means mounted in the bottom end of said housing, and having a centrally located hole, an upper face resiliently abutting against a bottom of the lower portion of said cap member;

a clip pin centrally located within said housing, said clip pin having opposing spring-like first and second contact fingers, said clip pin being located within said cap member, said first and second contact fingers each having top end portions formed into ear-like electrical contacts bent away from one another with each having an interior contact surface tightly abutting against one another for receiving therebetween an end of a center conductor of a coaxial cable passed through a central portion of said cap member above said boot, said second contact finger having a lower end terminal within the lower portion of said cap member above said washer means;

said first contact finger having and end portion extending from said cap member through the hole in said washer means and away from the bottom of said housing for providing an electrical contact for said clip pin; and a bottom edge of the bottom end of said housing being peened over to rigidly retain within said housing and force said washer means to compress against said cap member to provide a hermetic seal about said first contact finger, below the termination of the lower end of said second contract finger, and with the adjacent inside wall portion at the bottom of said housing, said washer means in turn imparting a longitudinal compressive force against the bottom of said cap member, for causing the upper portion of said cap member to compress the sidewalls and top portion of said boot to form a hermetic seal with the inside sidewall and top wall portions of said housing, and with center conductor of a coaxial cable passing through the center of said boot.

2. The connector of claim 1, wherein said cap member includes:

first cap means having a hollow interior cavity, an upper portion configured for fitting snugly within and abutting against the interior top and sidewalls of said boot, said upper portion including a top portion with a centrally located hole for receiving a central portion of said boot, and a lower portion of said first cap means extending from said upper portion and having an open bottom, said first cap means being responsive to an upward force upon a bottom edge of said lower portion, for compressing the sidewalls and top portion of said boot to form a hermetic seal with the inside sidewall and top wall portions of said housing; and second cap means located in said housing below said first cap means, having a hollow core, an upper portion configured to fit within the lower portion of said first cap means, and further having a lower portion of greater diameter than said upper portion, for providing a ledge for imposing an upward force against the bottom edge of said first cap means, in response to said washer means compressing against a bottom surface of said second cap means.

3. The connector of claim 2, wherein said first cap means further includes:

a circular cross-section;

diverging outside sidewalls extending from the upper portion to the lower portion thereof; and said lower portion having parallel sidewalls.

4. The connector of claim 3, wherein said second cap means further includes:

a circular cross-section;

the outside of said upper portion having downwardly diverging sidewalls;

said lower portion having parallel outside sidewalls with a stepped increase in diameter proximate the bottom thereof; and a partition being located wholly within an upper part of said lower portion.

5. The connector of claim 4, wherein said clip pin further includes:

a tab bent away from a side of a lower portion of said first contact finger, with the end of said tab being proximate a bottom surface of the partition of said second cap, for preventing upward movement of said clip pin; and a kinked section in said first contact finger proximate its entry point into the hole in said first washer for substantially preventing downward movement of said clip pin.

6. The connector of claim 2, wherein said first cap means further includes:

said upper portion having a first opposing pair of flat sidewalls, and a second opposing pair of arcuate sidewalls located between and connected to said first opposing pair of sidewalls, said first and second opposing pairs of sidewalls diverging from the top to the lower portion thereof; and said lower portion having a first opposing pair of flat sidewalls that are a partial extension of, but wider than, said first opposing pair of flat sidewalls of said upper portion, and a second opposing pair of arcuate sidewalls of greater diameter than said second opposing pair of arcuate sidewalls of said top portion.

7. The connector of claim 6, wherein said second cap means further includes:

the outside of said upper and lower portions each having parallel sidewalls;

a partition being located wholly within an upper part of said lower portion;

said lower portion sidewalls being circular; and said upper portion sidewalls being a pair of opposing arcuate members of smaller diameter than, and concentric with, said lower portion sidewalls.

8. The connector of claim 7, wherein said clip pin further includes:

a lower portion above said end portion being the widest portion of said clip pin and rectangular in shape for being securely retained in a rectangular slot in said partition of said second cap means; and strengthening ribs in an upper portion above said lower portion.

9. The connector of claim 8, wherein said clip pin further includes:

said ear-like electrical contacts of said first and second contact fingers, respectively, each having a semicircular shape for substantially maximizing the area of contact with the end of a center conductor of a coaxial cable positioned therebetween.

10. The connector of claim 1, wherein said housing consists of electrically conductive material.

11. The connector of claim 1, wherein said housing includes brass material having a Ni/Zn finish.

12. The connector of claim 1, wherein said boot consists of rubber material.

13. The connector of claim 1, wherein said washer means further includes:

a circular first washer of relatively ductile and deformable material having an outside diameter dimensioned for fitting snugly within said housing with a top face abutted against the bottom edge of the lower portion of said cap member, a bottom face, and a centrally located hole therethrough; and a circular second washer consisting of rigid dielectric material, a top face, a bottom face, a centrally located hole, and a diameter smaller than the inside diameter of said housing, the top face thereof being abutted against the bottom face of said first washer.

14. The connector of claim 13, wherein said first and second cap means, and said second washer each consist of plastic material.

15. The connector of claim 14, wherein said first washer consists of rubber material.

16. The connector of claim 13, wherein the centrally located hole of said first washer is conically-shaped with diverging sides from a top portion to the bottom of said first washer.

17. The connector of claim 13, wherein said second washer further includes:

said centrally located hole being rectangularly-shaped with diverging walls extending proximate the center depth thereof, with the sidewalls of the hole extending with parallel walls therefrom to the bottom face; and a bottom portion of smaller diameter than the upper portion thereof.

18. The connector of claim 1, wherein said boot further includes:

a cone-shaped depression in the center of its top portion for guiding the end of a center conductor of a coaxial cable being forced to penetrate therethrough at a center point; and the top portion of said boot being substantially thicker than the sidewalls, and configured to have an interior centrally located downwardly projecting conical portion configured to fit into and form a hermetic seal with a centrally located hole in the top portion of said cap member.

19. The connector of claim 1, wherein said washer means further includes:

a circular first washer of relatively ductile and deformable material having an outside diameter dimensioned for fitting snugly within said housing with a top face abutted against the bottom edge of the lower portion of said cap member, a bottom face, and a centrally located circular stepped portion on said top face being configured for fitting snugly within a hollow core of said lower portion of said cap member; and a circular second washer consisting of rigid dielectric, a top face, a bottom face, a centrally located hole, with the top face thereof being abutted against the bottom face of said first washer.

20. The connector of claim 1, wherein said boot further includes:

a cone-shaped depression in the center of its top portion for guiding the end of a center conductor of a coaxial cable being forced to penetrate therethrough at a center point; and the top portion of said boot being substantially thicker than the sidewalls, and configured to have an interior centrally located downwardly projecting truncated portion configured to fit into and form a hermetic seal with the hole in the top of said cap member.

21. A hermetically sealed female connector for a coaxial cable, comprising:

a barrel-shaped housing consisting of electrically conductive material, and having a top end with a centrally located hole forming an input port, upper and lower portions, an open bottom end, and a hollow cavity between said top and bottom ends;

a boot consisting of relatively ductile and deformable material having a memory, said boot having a circular cross-section, a closed top portion, diverging sidewalls extending from said top portion, a hollow interior cavity, and an interior centrally located downward projecting conical portion, said boot being positioned within said housing with the top portion of said boot configured to slightly protrude from the centrally located hole in the top end of said housing;

first cap means having a hollow interior cavity, an upper portion configured for fitting snugly within and abutting against the interior top and sidewalls of said boot, said upper portion including a centrally located hole in a top portion for receiving said conical portion of said boot to form a hermetic seal therewith, and a lower portion extending from said upper portion and having an open bottom, said first cap means being responsive to an upward force upon a bottom edge of said lower portion, for compressing the sidewalls and top portion of said boot to form a hermetic seal with the inside sidewall and top wall portions of said housing;

second cap means located in said housing below said first cap means, having a hollow core, an upper portion configured to fit within the lower portion of said first cap means, and further having a lower portion of greater diameter than said upper portion, for providing a ledge for imposing an upward force against the bottom edge of said first cap means;

clip pin means secured in said housing within said first and second cap means, said clip means having a pair of opposing spring fingers with first and second electrical contacts for receiving the end of a center conductor of a coaxial cable therebetween, and a lowermost third electrical contact extending out of the bottom of said housing; and washer means mounted in the bottom end of said housing, and having a centrally located hole though which said third electrical contact passes, an upper face abutting against the bottom of said second cap means for imposing an upward force thereupon, whereby a bottom portion of the bottom end of said housing is peened over to secure said washer means under compressive force in said housing to maintain said upward force upon said first and second cap means to provide a hermetic seal about said lowermost third electrical contact and with the adjacent inside wall portion at the bottom end of said housing.

22. The connector of claim 21, wherein said washer means further includes means for hermetically sealing the bottom end of said housing.

23. The connector of claim 21, wherein said washer means further includes:

a circular first washer of relatively ductile and deformable material having an outside diameter dimensioned for fitting snugly within said housing with a top face abutted against the bottom edge of the lower portion of said first cap means, a bottom face, and a centrally located hole therethrough; and a circular second washer consisting of rigid dielectric material, a top face, a bottom face, a centrally located hole, and a diameter smaller than the inside diameter of said housing, the top face thereof being abutted against the bottom face of said first washer.

24. The connector of claim 23, wherein said first washer consists of rubber material, and said second washer consists of plastic material.

25. The connector of claim 21, wherein said boot consists of rubber material.

26. The connector of claim 21, wherein said washer means further includes:

a circular first washer of relatively ductile and deformable material having an outside diameter dimensioned for fitting snugly within said housing with a top face abutted against the bottom edge of the lower portion of said cap member, a bottom face, and a centrally located circular stepped portion on said top face being configured for fitting snugly within a hollow core of said lower portion of said cap member; and a circular second washer consisting of rigid dielectric, a top face, a bottom face, a centrally located hole, with the top face thereof being abutted against the bottom face of said first washer.

27. The connector of claim 21, wherein said boot further includes:

a cone-shaped depression in the center of its top portion for guiding the end of a center conductor of a coaxial cable being forced to penetrate therethrough at a center point; and the top portion of said boot being substantially thicker than the sidewalls, and configured to have an interior centrally located downwardly projecting truncated portion configured to fit into and form a hermetic seal with the hole in the top of said cap member.

28. A hermetically sealed female connector for a coaxial cable, comprises a barrel-shaped electrically conductive housing enclosing in the order given from a top end providing an input port to a bottom end, the following components including:

a resilient boot having a center portion partially protruding from a central hole in the top end;

a first cap having an upper portion within the boot and a lower portion;

a second cap having an upper portion contained within the lower portion of the first cap, the second cap also having a lower portion with a top edge abutting against the bottom of the first cap;

a resilient washer with a top face abutting against the bottom of the second cap;

a rigid dielectric material washer with a top face abutting against the bottom face of the resilient washer; and a clip pin secured in the central longitudinal portion of the housing between the input port and the bottom end with an end of the clip protruding out of the bottom end of the housing, the bottom end of the housing being peened over to retain the connector components under compression for causing the resilient boot and resilient washer to form hermetic seals with interior walls of the housing and clip pin.

29. A female connector for a coaxial cable, comprising:

a barrel-shaped housing having a top end with a centrally located hole forming an input port, at least a threaded upper portion proximate said input port, an open bottom end, and hollow cylindrical cavity between said top and bottom ends;

a clip pin centrally located within said housing, said clip pin having opposing spring-like first and second contact fingers said first and second contact fingers each having, proximate said input port, top end portions formed into ear-like electrical contacts bent away from one another with each having an interior semicircular contact surface tightly abutting against one another for receiving an end of a center conductor of a coaxial cable therebetween, said first and second contact fingers being rigidly connected together immediately below said electrical contacts, said second contact finger being truncated at an end positioned in a lower portion of said housing, said first contact finger having an end portion extending away from the bottom end of said housing;

dielectric means located within said housing for retaining said clip pin therein, and preventing longitudinal movement of said clip pin;

a resilient washer assembly abutting against a bottom face of said dielectric means with said end portion of said first contact finger extending through a central hole in said washer assembly; and a bottom portion of said housing being peened over to rigidly secure said washer assembly against said bottom face of said dielectric means to provide a hermetic seal about said first contact finger below the truncated end of said second contact finger, and with the adjacent inside wall portion at the bottom of said housing.

30. The connector of claim 29, wherein said clip pin further includes:

said first and second contact fingers immediately below respective ear-like electrical contacts being formed into opposing straight portions parallel to the longitudinal axis of said housing, followed by opposing converging portions, followed by abutting straight portions parallel to the longitudinal axis of the housing, the abutting straight portions including means for rigidly holding them together.

31. A hermetically sealed female connector for a coaxial cable, comprising:

a housing having a bottom end with a centrally located hole, a partially open top end forming an input port, and a hollow cavity between said top and bottom ends;

a cap member having a hollow core, an upper portion with a centrally located hole, said upper portion being configured to fit within the top end of said housing, and a lower portion extending from said upper portion toward the bottom end of said housing, said cap member being responsive to a compressive force;

a washer means for providing a hermetic seal, said washer means being mounted within the bottom end of said housing, and having a centrally located hole, an upper face resiliently abutting against a bottom of the lower portion of said cap member;

a clip pin centrally located within said housing, said clip pin having at least opposing spring-like first and second contact fingers, said clip pin being located within said cap member, said first and second contact fingers each having top end portions forming electrical contacts bent away from one another with each having an interior contact surface for receiving therebetween an end of a center conductor of a coaxial cable passed through the centrally located hole in said upper portion of said cap member, said second contact finger having a lower end terminated within lower portion of said cap member above said washer means;

said first contact finger having an end portion extending from said cap member through said washer means and away from the bottom end of said housing for providing an electrical contact for said clip pin; and an edge of end of said housing being peened over to rigidly retain within said housing and force the lower portion of said cap member to compress against the washer means to provide a tight hermetic seal about said end portion of said first contact finger below the termination of the lower end of said second contact finger and with an adjacent inside wall portion within the bottom end of said housing.

32. The connector of claim 31, wherein said cap member includes:

first cap means having a hollow interior cavity, an upper portion configured for fitting snugly within and abutting against a top edge and sidewalls of said housing, said upper portion including a top portion with a centrally located hole for receiving the center conductor of the coaxial cable, and a lower portion of said first cap means extending from said upper portion and having an open bottom, said first cap means being responsive to a compressive force upon a top edge of said upper portion; and second cap means located in said housing below said first cap means, having a hollow core, an upper portion configured to fit within the lower portion of said first cap means, and further having a lower portion of greater diameter than said upper portion, for providing a ledge for receiving a compressive force from the bottom edge of said first cap means, in response to said top edge of said housing compressing against the top edge of said first cap means, for compressing the upper face of said washer means to form a hermetic seal with the inside sidewall of said housing and the end portion of said clip pin.

33. The connector of claim 32, wherein said first cap means further includes:

a circular cross-section;

straight parallel sidewalls extending from the upper portion to the lower portion thereof, said upper portion having a first opposing pair of flat inner sidewalls; and a second opposing pair of arcuate inner sidewalls located between and connected to said first opposing pair of inner sidewalls, said first and second opposing pairs of inner sidewalls extending from the top to the lower portion thereof.

34. The connector of claim 33, wherein said second cap means further includes:

the outside of said upper and lower portions each having parallel sidewalls;

said lower portion sidewalls being circular; and said upper portion sidewalls being a pair of opposing arcuate members of smaller diameter than, and concentric with, said lower portion sidewalls.

35. The connector of claim 31, wherein said housing consists of electrically conductive material.

36. The connector of claim 31, wherein said housing includes brass material having a Ni/Zn finish.

37. The connector of claim 31, wherein said housing is barrel-shaped.

38. The connector of claim 31, wherein the bottom end of said housing is integrally cast with an opening of a main housing structure.

39. The connector of claim 31, wherein said washer means further includes:

a circular first washer of relatively ductile and deformable material having an outside diameter dimensioned for fitting snugly within said housing with a top face abutted against the bottom of the lower portion of said cap member, a bottom face, and a centrally located hole on said top face; and a circular second washer consisting of rigid dielectric material, a top face, a bottom face, and a centrally located hole, the top face thereof being abutted against the bottom face of said first washer.

40. The connector of claim 39, wherein the bottom face of said first washer further includes a circular protrusion with converging sidewalls, projecting away therefrom and an edge portion extending along the periphery of said protrusion.

41. The connector of claim 40, wherein the top face of said second washer further includes a circular depression, and an edge portion extending along the periphery of said depression, said depression being configured for receiving and hermetically coupling with said protrusion of said first washer.

42. The connector of claim 39, wherein said first and second cap means, and said second washer each consist of plastic material.

43. The connector of claim 39, wherein said first washer consists of rubber material.

44. The connector of claim 39, wherein said first washer includes a centrally located depression that is conically-shaped with converging side portions from a top portion to a middle portion within said first washer.

45. The connector of claim 39, wherein said second washer further includes said centrally located hole being rectangularly-shaped with diverging walls, with the sidewalls of the hole extending with parallel walls therefrom to the bottom face.

46. The connector of claim 39, wherein said clip pin further includes:

a lower portion above said end portion being the widest portion of said clip pin and rectangular in shape for being securely retained in a rectangular slot in said second cap means.

47. The connector of claim 46, wherein said clip pin further includes:

said electrical contacts of said first and second contact fingers, respectively, each having a semicircular shape for substantially maximizing the area of contact with the end of a center conductor of a coaxial cable positioned therebetween.

48. The connector of claim 47, wherein said clip pin further includes a pair of flaps, each flap at diagonally opposing corners, extending substantially perpendicular from a side edge portion of one of said electrical contacts toward the other electrical contact.

49. The connector of claim 48, wherein the end portion of said clip pin further includes a sharp tip portion being configured for piercing through the centrally located depression and body of said first washer.

* * * * *